US011715875B2

(12) United States Patent
Eom

(10) Patent No.: US 11,715,875 B2
(45) Date of Patent: Aug. 1, 2023

(54) INDIVIDUAL ROTATING RADIATING ELEMENT AND ARRAY ANTENNA USING THE SAME

(71) Applicant: ELECTRONICS AND TELECOMMUNICATIONS RESEARCH INSTITUTE, Daejeon (KR)

(72) Inventor: Soon Young Eom, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 17/519,807

(22) Filed: Nov. 5, 2021

(65) Prior Publication Data

US 2022/0149521 A1 May 12, 2022

(30) Foreign Application Priority Data

Nov. 6, 2020 (KR) ..... 10-2020-0147841
Jul. 13, 2021 (KR) ..... 10-2021-0091309

(51) Int. Cl.
*H01Q 3/32* (2006.01)
*H01Q 11/08* (2006.01)

(52) U.S. Cl.
CPC ..... *H01Q 3/32* (2013.01); *H01Q 11/08* (2013.01)

(58) Field of Classification Search
CPC . H01Q 11/08; H01Q 3/32; H01Q 3/01; H01Q 21/067
See application file for complete search history.

(56) References Cited

U.S. PATENT DOCUMENTS 4,427,984 A * 1/1984 Anderson ..... H01Q 21/067 343/895
4,823,136 A 4/1989 Nathanson et al.
(Continued)

FOREIGN PATENT DOCUMENTS

CN 2852420 Y * 12/2006
EP 1146592 A1 10/2001
(Continued)

OTHER PUBLICATIONS

"US Grants C-COM Patent For Phase Shifter Technology", Satellite Markets & Research, Nov. 20, 2018, http://www.satellitemarkets.com/productsservices/us-grants-c-com-patent-phase-shifter-technology.
(Continued)

*Primary Examiner* — Ab Salam Alkassim, Jr.
*Assistant Examiner* — Anh N Ho
(74) *Attorney, Agent, or Firm* — Rabin & Berdo, P.C.

(57) ABSTRACT

Disclosed is an individual rotating radiating element which causes an electrical phase change with the mechanical rotary motion of a rotating radiating element and an array antenna using the same. The individual rotating radiating element comprises an auxiliary structure formed of a dielectric, a helix element inserted into a spiral groove on a side surface of the auxiliary structure, a ground plate coupled to a lower surface of the auxiliary structure; a driving unit including an
(Continued)

opening in which the ground plate is placed and rotating the auxiliary structure, and a spatial electromagnetic coupling structure having a first feed pin and a second feed pin electromagnetically coupled each other during power feeding is inserted through a lower surface spaced apart from the upper surface with an inner space therebetween.

16 Claims, 27 Drawing Sheets

(56) References Cited

U.S. PATENT DOCUMENTS

| | | | | |
|---|---|---|---|---|
| 5,345,248 | A * | 9/1994 | Hwang | H01Q 11/08 343/846 |
| 6,759,980 | B2 | 7/2004 | Chen et al. | |
| 7,292,203 | B2 * | 11/2007 | Craggs | H01Q 11/08 343/895 |
| 7,439,901 | B2 | 10/2008 | Needham et al. | |
| 8,334,809 | B2 | 12/2012 | Nichols et al. | |
| 9,444,148 | B2 * | 9/2016 | Shashi | H01Q 21/067 |
| 9,515,373 | B2 * | 12/2016 | Manry, Jr. | H02J 50/20 |
| 10,014,563 | B2 | 7/2018 | Abdellatif et al. | |
| 10,734,717 | B2 * | 8/2020 | Hosseini | H01Q 1/405 |
| 10,817,682 | B2 * | 10/2020 | Swope | H01Q 11/08 |
| 11,223,137 | B2 * | 1/2022 | Yanagi | H01Q 3/32 |
| 2002/0175859 | A1 | 11/2002 | Newberg et al. | |
| 2003/0164805 | A1 * | 9/2003 | Strickland | H01Q 21/067 343/895 |

FOREIGN PATENT DOCUMENTS

| | | | | |
|---|---|---|---|---|
| EP | 2725657 | A1 | 4/2014 | |
| JP | H11308019 | A * | 11/1999 | |
| JP | 6584727 | B2 * | 10/2019 | H01P 1/182 |
| KR | 10-0553555 | B1 | 2/2006 | |
| KR | 1020100108810 | A | 10/2010 | |
| KR | 10-2012-0102323 | A | 9/2012 | |
| WO | 2005/048401 | A1 | 5/2005 | |
| WO | 2013/045267 | A1 | 4/2013 | |

OTHER PUBLICATIONS

Ashok K. Agrawal et al., "Active Phased Array Antenna Development for Modern Shipboard Radar Systems," Johns Hopkins APL Technical Digest, vol. 22, No. 4, pp. 600-613, Oct. 2001.

Keith Benson, "Phased Array Beamforming ICs Simplify Antenna Design," Analog Dialogue 53-01, pp. 1-4, Jan. 2019.

"C-Com Reports Successful Tests Using Patent Pending Ka-Band Phased Array Technology", May 4, 2016, C-COM Satellite Systems Inc, https://www.c-comsat.com/news/c-com-reports-successful-tests-using-patented-ka-band-phased-array-technology/.

* cited by examiner

INDIVIDUAL ROTATING RADIATING ELEMENT AND ARRAY ANTENNA USING THE SAME

CROSS-REFERENCE TO RELATED APPLICATION

This application claims priority to Korean Patent Application No. 2020-0147841 filed on Nov. 6, 2020 and Korean Patent Application No. 2021-0091309 filed on Jul. 13, 2021 in the Korean Intellectual Property Office (KIPO), the entire contents of which are hereby incorporated by reference.

BACKGROUND

1. Technical Field

Example embodiments of the present invention relate in general to an array antenna and more specifically to an individual rotating radiating element which causes an electrical phase change with the mechanical rotary motion of a rotating radiating element and an array antenna which mechanically causes an angular phase change using the individual rotating radiating element.

2. Related Art

As shown in FIG. 1, a conventional array antenna for wireless communication and radars uses an analog or digital phase shifter in unit active channel blocks (ACBs) connected to a power combiner to generate a high-speed electronical beam and generates a high-speed electronical beam through radiating elements (REs) according to external control.

On the other hand, in the conventional array antenna, the cost of the phase shifter element is high, and an additional phase control circuit device is required. Also, a high power amplifier or a low noise amplifier is required at an output port or an input port of the array antenna due to high insertion loss. In addition, the conventional array antenna has a problem of additional incidental costs such as the cost of a heat dissipation system to be installed due to high power consumption, and thus the price of the phased array antenna system is increasing.

In the conventional array antenna, unit sub-arrays which are phase-controllable array units have a small size to generate a wide-range electronical beam, and thus the total number of sub-arrays used in the array antenna having the same size is increased. In this case, the number of phase shifters also increases, and accordingly, the cost of circuit integration and solving heat dissipation, etc. is increased, thereby increasing the price of the entire antenna system.

Also, a conventional mechanical antenna that moves the entire antenna is large and heavy and since the mechanical antenna provides low-speed mechanical beam forming, there is a disadvantage in that the target tracking performance is not good.

SUMMARY

The present invention is designed to overcome the disadvantages of the prior art described above, an object of the present invention is to provide an individual rotating radiating element capable of generating an electrical phase lead or phase delay by rotating the resonant radiating element in a left or right direction, and an array antenna having a mechanical angular phase change thereby.

Another object of the present invention is, by controlling light-weight individual rotating radiating elements having a mechanical rotating body to rotate at high speed and controlling angular phases through this, to provide an array antenna capable of forming a relatively high-speed antenna tracking beam, compared with the conventional mechanical array antenna, and to provide an individual rotating radiating element for the array antenna.

According to an aspect of an exemplary embodiment of the present disclosure, An individual rotating radiating element comprises: an auxiliary structure formed of a dielectric; a helix element inserted into a spiral groove on a side surface of the auxiliary structure; a ground plate coupled to a lower surface of the auxiliary structure; a driving unit including an opening in which the ground plate is placed and rotating the auxiliary structure in which the helix element is inserted together with the ground plate; and a spatial electromagnetic coupling structure in which a first feed pin coupled to a low portion of the driving unit and connected to one end of the helix element penetrates a center of the ground plate and is inserted from an upper surface of the spatial electromagnetic coupling structure and in which a second feed pin electromagnetically coupled with the first feed pin during power feeding is inserted through a lower surface spaced apart from the upper surface with an inner space therebetween.

The second feed pin may have a hollow cylinder shape surrounding an end portion of the first feed pin.

The second feed pin may be disposed on one side apart from an end portion of the first feed pin to be electromagnetically coupled with the end portion of the first feed pin when the power is fed.

The spatial electromagnetic coupling structure may include a lower concave and convex portion installed on an upper surface thereof, and the lower concave and convex portion may be spaced apart from an upper concave and convex portion of a lower portion of the ground plate to fit or to be insertion-coupled.

Further, a distance between the upper concave and convex portion and the lower concave and convex portion may be determined based on a design frequency band, as a design variable of capacitive electromagnetic coupling for low-loss radio frequency (RF) signal transmission.

Further, a diameter of the helix element may be equal to a diameter of the auxiliary structure or smaller than a diameter of the ground plate.

Further, a height of the helix element may be larger than the diameter of the helix element.

Furthermore, a size of the inner space of the spatial electromagnetic coupling structure and a coupling length and a distance between the first feed pin and the second feed pin may be determined based on a design frequency band.

According to another aspect of an exemplary embodiment of the present disclosure, an array antenna may comprise: a plurality of radiating elements arranged apart from each other with an array shape; a driving unit arrangement configured to support each of the plurality of radiating elements; and a spatial feed network for array configured to be spatially and electromagnetically coupled with the plurality of radiating elements, wherein each of the plurality of radiating elements comprises: an auxiliary structure formed of a dielectric; a helix element inserted into a spiral groove on a side surface of the auxiliary structure; and a ground plate coupled to a lower surface of the auxiliary structure, wherein the driving unit arrangement comprises a plurality of driving units having an opening in which the ground plate is placed and rotating the auxiliary structure in which the helix element is inserted together with the ground plate, and wherein the spatial feed network comprises at least one spatial electromagnetic coupling structure in which a first feed pin coupled to a low portion of the driving unit arrangement and connected to one end of the helix element penetrates a center of the ground plate and is inserted from an upper surface of the spatial electromagnetic coupling structure and in which a second feed pin electromagnetically coupled with the first feed pin during power feeding is inserted through a lower surface spaced apart from the upper surface with an inner space therebetween.

The spatial feed network may include a plurality of spatial feed structures for array, wherein each of the plurality of spatial feed structures may have an aperture tapering for amplitude control of an array antenna aperture.

The array antenna may further comprise peripherals for the array antenna, the peripherals being connected to the driving unit arrangement and the spatial feed network, wherein the peripherals may comprise an antenna control unit configured to individually control operations of the plurality of driving units in the driving unit arrangement on the basis of mechanical phase control data which is calculated in advance.

The peripherals may further comprise a sensor unit for open loop control, wherein a signal detected by the sensor unit is transmitted to the antenna control unit.

The spatial feed network may include at least one inner space in which the plurality of first feed pins are electromagnetically coupled with a single second feed pin.

BRIEF DESCRIPTION OF DRAWINGS

Example embodiments of the present invention will become more apparent by describing in detail example embodiments of the present invention with reference to the accompanying drawings, in which.

DESCRIPTION OF EXAMPLE EMBODIMENTS

Figure 1:
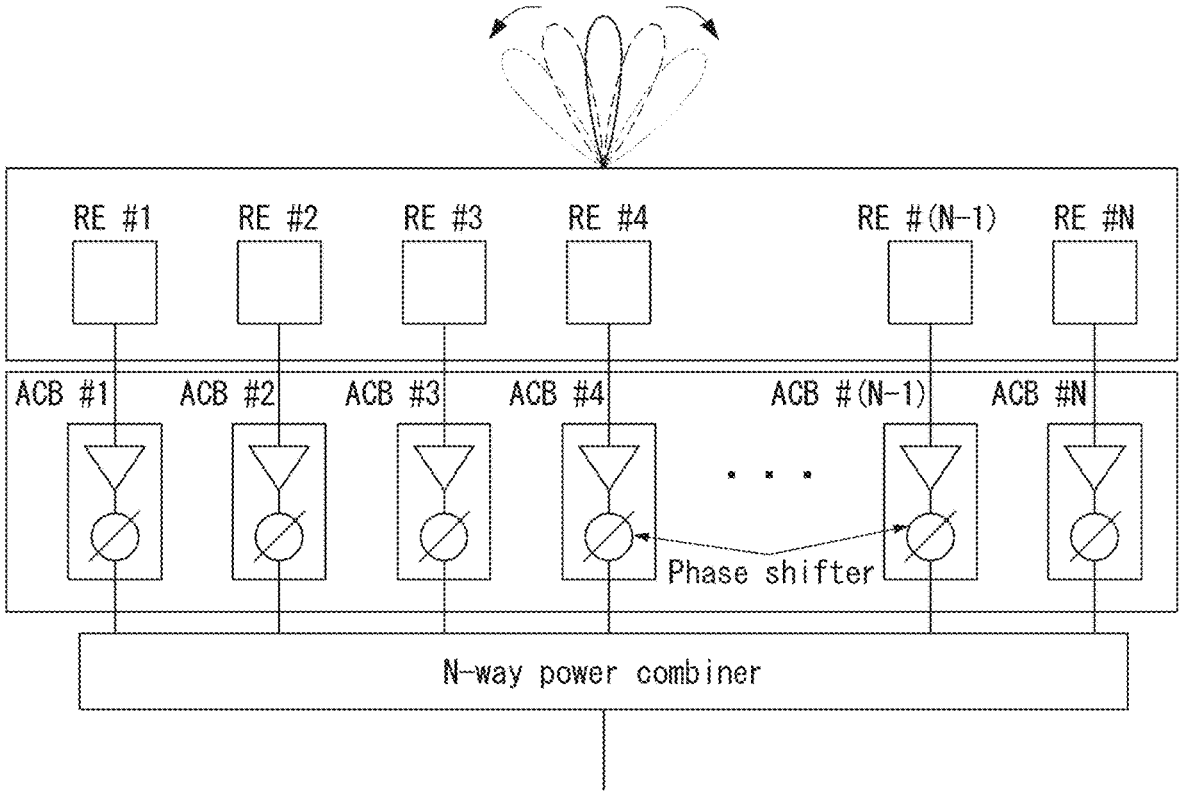
FIG. 1 is a view for describing a conventional array antenna using a phase shifter element.

For a more clear understanding of the features and advantages of the present disclosure, exemplary embodiments of the present disclosure will be described in detail with reference to the accompanied drawings. However, it should be understood that the present disclosure is not limited to particular embodiments disclosed herein but includes all modifications, equivalents, and alternatives falling within the spirit and scope of the present disclosure. In the drawings, similar or corresponding components may be designated by the same or similar reference numerals.

The terminologies including ordinals such as "first" and "second" designated for explaining various components in this specification are used to discriminate a component from the other ones but are not intended to be limiting to a specific component. For example, a second component may be referred to as a first component and, similarly, a first component may also be referred to as a second component without departing from the scope of the present disclosure. As used herein, the term "and/or" may include a presence of one or more of the associated listed items and any and all combinations of the listed items.

When a component is referred to as being "connected" or "coupled" to another component, the component may be directly connected or coupled logically or physically to the other component or indirectly through an object therebetween. Contrarily, when a component is referred to as being "directly connected" or "directly coupled" to another component, it is to be understood that there is no intervening object between the components. Other words used to describe the relationship between elements should be interpreted in a similar fashion.

The terminologies are used herein for the purpose of describing particular exemplary embodiments only and are not intended to limit the present disclosure. The singular forms include plural referents as well unless the context clearly dictates otherwise. Also, the expressions "comprises," "includes," "constructed," "configured" are used to refer a presence of a combination of stated features, numbers, processing steps, operations, elements, or components, but are not intended to preclude a presence or addition of another feature, number, processing step, operation, element, or component.

Unless defined otherwise, all terms used herein, including technical or scientific terms, have the same meaning as commonly understood by those of ordinary skill in the art to which the present disclosure pertains. Terms such as those defined in a commonly used dictionary should be interpreted as having meanings consistent with their meanings in the context of related literatures and will not be interpreted as having ideal or excessively formal meanings unless explicitly defined in the present application.

A communication system or memory system to which example embodiments of the present invention are applied will be described. The communication system or memory system to which example embodiments of the present invention are applied is not limited to the following description. Example embodiments of the present invention may be applied to various communication systems. Here, the term "communication system" may be used interchangeably with "communication network."

Hereinafter, exemplary embodiments of the present invention will be described in detail with reference to the accompanying drawings.

Figure 2:
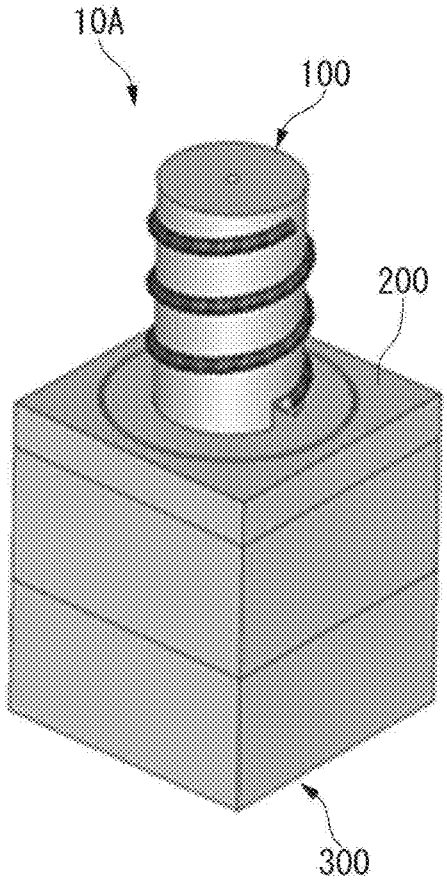
FIG. 2 is a perspective view of an individual rotating radiating element according to a first example embodiment of the present invention.
Figure 3:
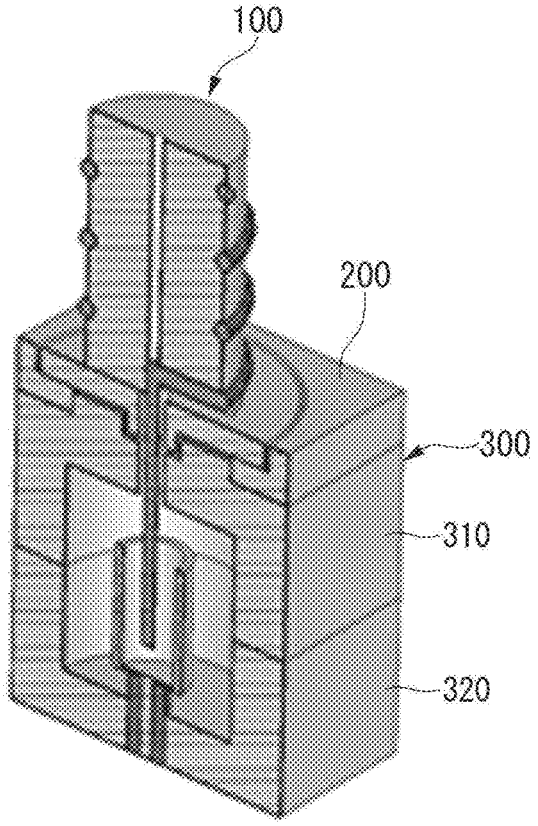
FIG. 3 is a longitudinal section view of the radiating element of FIG. 2.

FIG. 2 is a perspective view of an individual rotating radiating element according to a first example embodiment of the present invention. FIG. 3 is a longitudinal section view of the radiating element of FIG. 2. FIG. 4 is a set of an exploded perspective view of the radiating element of FIG. 2 and cross-sectional views of parts thereof. FIG. 5 is a diagram showing a coupling relationship among major components of the radiating element (hereinafter, referred to as 'antenna array element' too) of FIG. 2.

Referring to FIGS. 2 to 5, an antenna array element 10A includes a rotating radiating element 100, a driving unit 200 for actuating the rotating radiating element 100, and a spatial electromagnetic coupling structure 300 for efficiently transmitting a radio frequency (RF) signal to the rotating radiating element 100. The rotating radiating element 100 is a rotating body, and the driving unit 200 and the spatial electromagnetic coupling structure 300 are non-rotating bodies.

As shown in FIG. 4, the rotating radiating element 100 has a form in which a helix element 110 supported by an auxiliary structure 120 and a ground plate 130 supporting the bottom of the auxiliary structure 120 are coupled together.

The helix element 110 is inserted into a spiral groove around the side surface of the auxiliary structure 120, and one end thereof is formed to pass through an opening positioned at the center of the auxiliary structure 120 via a hollow hole of the ground plate 130. The material of the auxiliary structure 120 is a dielectric, and the ground plate 130 is formed of a metal, a metallic material, or a conductive material. The ground plate 130 may have a lower concave and convex portion which protrudes from the center of the bottom.

Figure 4A:
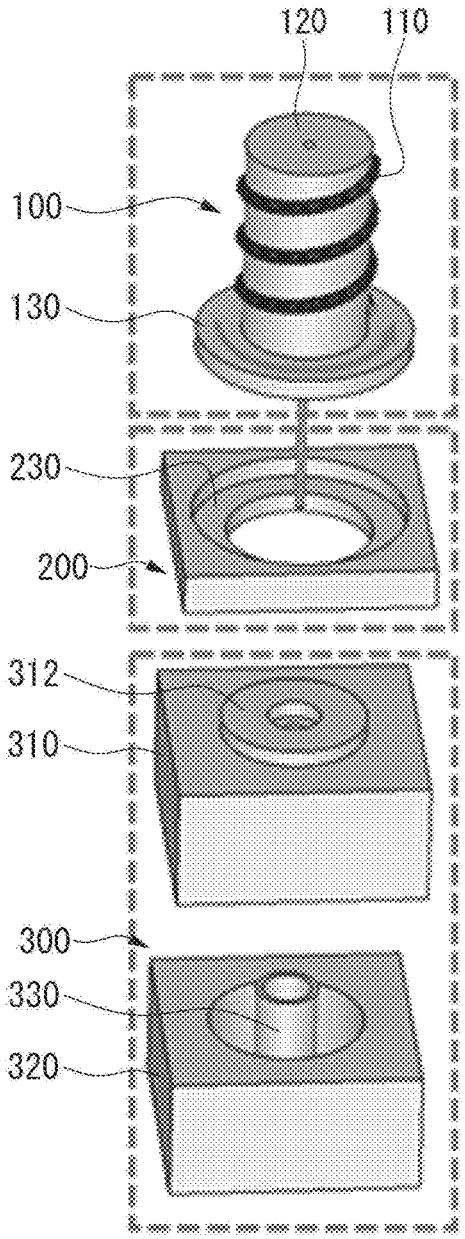
FIGS. 4A and 4B are sets of an exploded perspective view of the radiating element of FIG. 2 and cross-sectional views of parts thereof.
Figure 4B:
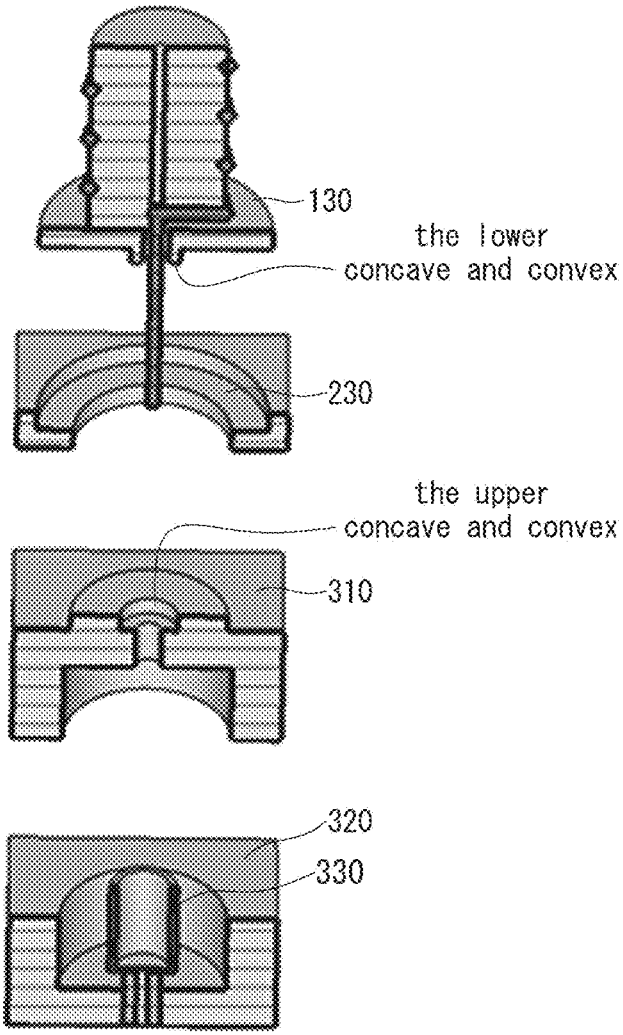
Figure 5:
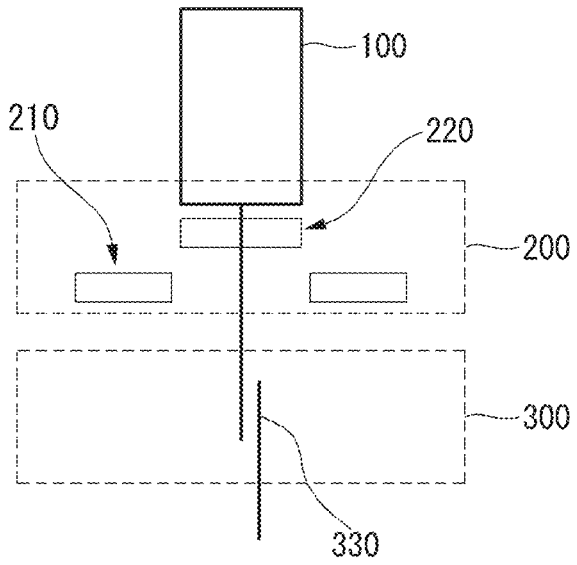
FIG. 5 is a diagram showing a coupling relationship among major components of the radiating element of FIG. 2.

As shown in FIGS. 4A and 4B, the driving unit 200 may include an opening 230 having a concave opening or a step in which the rotating radiating element 100 or the ground plate 130 of the rotating radiating element 100 is placed. the driving unit 200 may include an actuator for rotating the radiating element 100.

Also, as shown in FIG. 5, the driving unit 200 may include a stator 210 therein. The stator 210 may have a plurality of pairs of an iron core and a coil for forming different phases. The stator 210 may produce alternating magnetic fields according to external control and rotate a rotor 220 therearound. The rotor 220 may be formed in the driving unit 200 but is not limited thereto. The rotor 220 may be installed by being inserted into an upper concave and convex portion or the like of an upper structure 310 of the spatial electromagnetic coupling structure 300 which will be described below.

Also, the driving unit 200 may be manufactured in the form of a driving unit arrangement including a thin printed circuit board (PCB) on which a plurality of driving units are arranged to facilitate control and manufacturing of an extended antenna array.

The spatial electromagnetic coupling structure 300 may include a lower structure 320 having an electromagnetic coupling feeder and the upper structure 310 coupled onto the lower structure 320 as shown in FIGS. 3 and 4. The upper structure 310 may include an upper concave and convex portion 312 which is inserted into the opening 230 of the driving unit 200. Here, the lower concave and convex portion of the ground plate 130 may be inserted into a central concave portion of the upper concave and convex portion 312 in the opening 230 of the driving unit 200.

The electromagnetic coupling feeder may include a feed supply 330 in the form of a hollow cylinder, and a lower end of the feed supply 330 may extend through the center of a lower portion of the lower structure 320. Here, an external dielectric may be interposed between the lower structure 320 and the lower end of the feed supply 330.

As shown in FIG. 5, when the rotor 220 in the driving unit 200 rotates due to interaction between the stator 210 and the rotor 220, the rotating radiating element 100 may also rotate.

According to the above-described configuration, when the rotor 220 in the driving unit 200 rotates left or right according to external control, the rotating radiating element 100 floating above the rotor 220 may rotate left or right according to rotation of the rotor 220.

Figure 6:
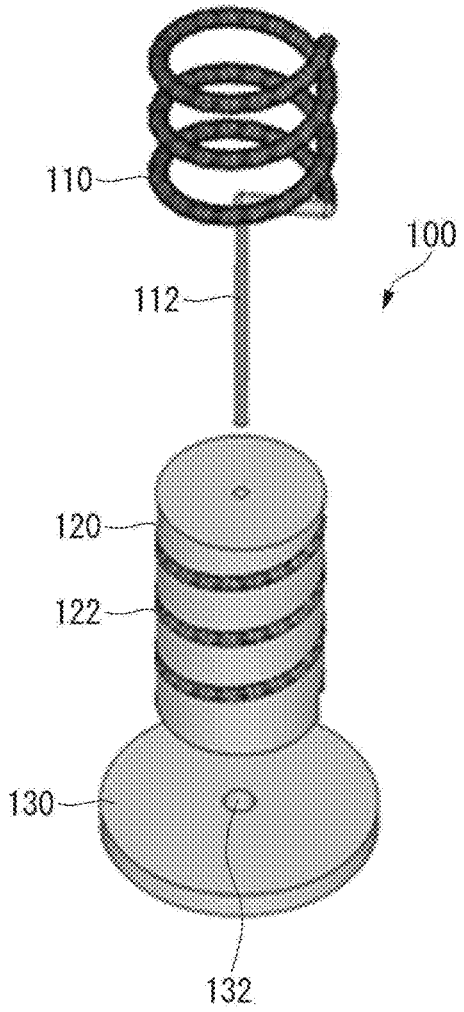
FIG. 6 is an exploded perspective view of the rotating radiating element of FIG. 2.

FIG. 6 is an exploded perspective view of the rotating radiating element of FIG. 2. FIG. 7 is a set of views of the rotating radiating element, which is a rotating body, of FIG. 6, illustrating design variables of the rotating radiating element.

Referring to FIG. 6, the rotating radiating element 100 includes the helix element 110 for generating circular polarization, the auxiliary structure 120 for maintaining the helix element 110 in a fixed form, and the ground plate 130 for providing an electrical passage 132 of a feed pin 112 positioned at the center of the helix element 110.

The helix element 110 is a helix structure. The helix element 110 is fed at the dead center or central portion thereof to provide a uniform electrical phase change and may have a predesigned helix diameter, tilt angle, and number of helical turns (height) to provide the optimal radiation performance of the radiating element. The feed pin 112 may have an optical length so that the helix element 110 optimally receives an RF signal which is supplied through the air from a non-rotating body.

For the auxiliary structure 120, a material with a low permittivity is employed for efficient radiation of the helix element 110. The auxiliary structure has a spiral groove 122 on the external side surface thereof.

The ground plate 130 provides the electrical passage 132 for the feed pin 112 of the helix element 110. For example, the ground plate 130 has an electrically conductive characteristic for providing, for example, a 50Ω coaxial line.

The helix element 110 and the auxiliary structure 120 may be combined and then coupled to an upper portion of the ground plate 130. For the coupling, an adhesive, a screw, or the like may be used.

The assembled rotating radiating element 100 may electrically cause a phase change by rotating left or right at a constant speed due to the rotating body controlled externally, that is, in the driving unit 200 on a lower side to which the feed pin 112 extends.

Figure 7A:
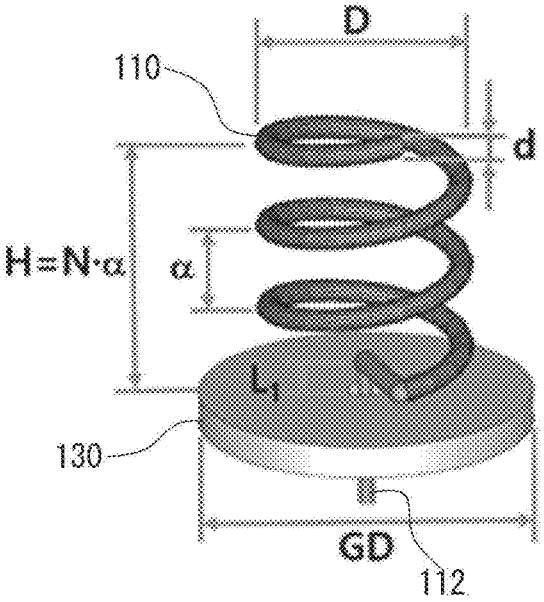
FIGS. 7A and 7B are a set of views of the single rotating radiating element, which is a rotating body, of FIG. 6, illustrating design variables of the single rotating radiating element.
Figure 7B:
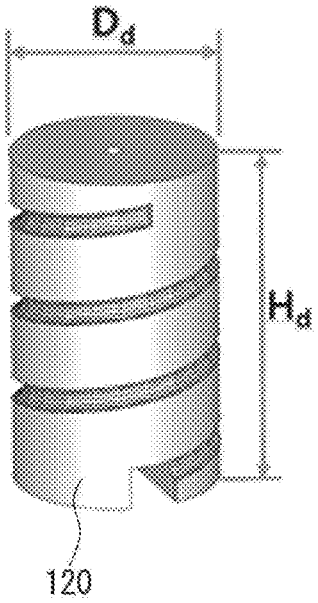

Design variables of the above-described rotating radiating element 100 include a helix diameter D, a pitch interval α, a helix height H, the number of helical turns N, a line diameter d, an input feed length $L_1$, a ground plate diameter GD, a diameter $D_d$ of the auxiliary structure 120 which is a dielectric, a height $H_d$ of the auxiliary structure 120, etc. as shown in FIG. 7A regarding the helix element 110 and the ground plate 130 and shown in FIG. 7B regarding the auxiliary structure 120.

The rotating radiating element 100 according to this example embodiment may be designed to have right-hand circular polarization in the Ku band (11.75 GHz to 12.75 GHz) to verify the function and electrical performance thereof but is not limited to this design. According to another example embodiment, the rotating radiating element 100 may be designed to have right-hand circular polarization or left-hand circular polarization in an RF band excluding the Ku band.

The design variables of an optimally designed rotating radiating element, that is, a helical radiating element, are shown in Table 1.

TABLE 1

| | Entry | Design variable | Design value |
|---|---|---|---|
| Helix | Helix diameter | D | 6.0 mm |
| | Pitch interval | α | 2.65 mm |
| | Helix height | H | 7.95 mm |
| | Number of helical turns | N | 3 |
| | Line diameter | d | 0.7 mm |
| | Input feed length | $L_1$ | 0.9 mm |
| | Ground plate diameter | GD | 10.3 mm |
| Cylindrical dielectric | Permittivity | $\varepsilon_r$ | 3.0 |
| | Loss tangent | tan δ | 0.025 |
| | Diameter | $D_d$ | 6.0 mm |
| | Height | $H_d$ | 9.9 mm |

As shown in Table 1, among the design variables of a helical radiating element, the helix diameter D of the helix element 110 may be 6.0 mm, the pitch interval α may be 2.65 mm, the helix height H may be 7.95 mm, the number of helical turns N may be 3, the line diameter d may be 0.7 mm, the input feed length $L_1$ may be 0.9 mm, and the diameter GD of the ground plate 130 may be 10.3 mm. Also, the diameter $D_d$ of the auxiliary structure 120, which is a cylindrical dielectric, may be 6.0 mm, the height $H_d$ of the auxiliary structure 120 may be 9.9 mm, the permittivity $\varepsilon_r$ may be 3.0, and the loss tangent tanδ may be 0.025.

Meanwhile, the design variables of the above-described rotating radiating element 100 may be increased or reduced to values having a relative ratio within a certain range.

A rotary joint which connects a rotating body and a non-rotating body, that is, the driving unit 200, may be designed in the Ku band (11.75 GHz to 12.75 GHz) to verify the function and electrical performance thereof or to be used in practice, but is not limited to this design.

Figure 8:
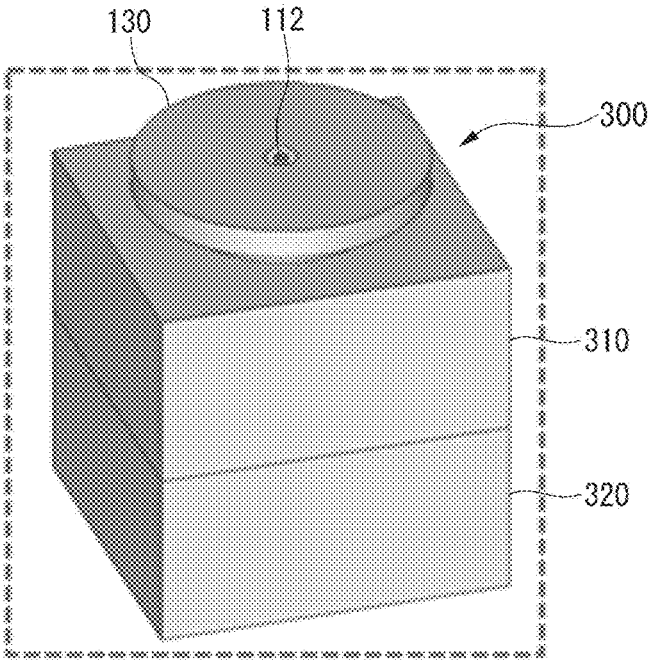
FIG. 8 is a perspective view showing the bonding structure of the ground plate of the rotating radiating element and the spatial electromagnetic coupling structure in the radiating element of FIG. 2.
Figure 9:
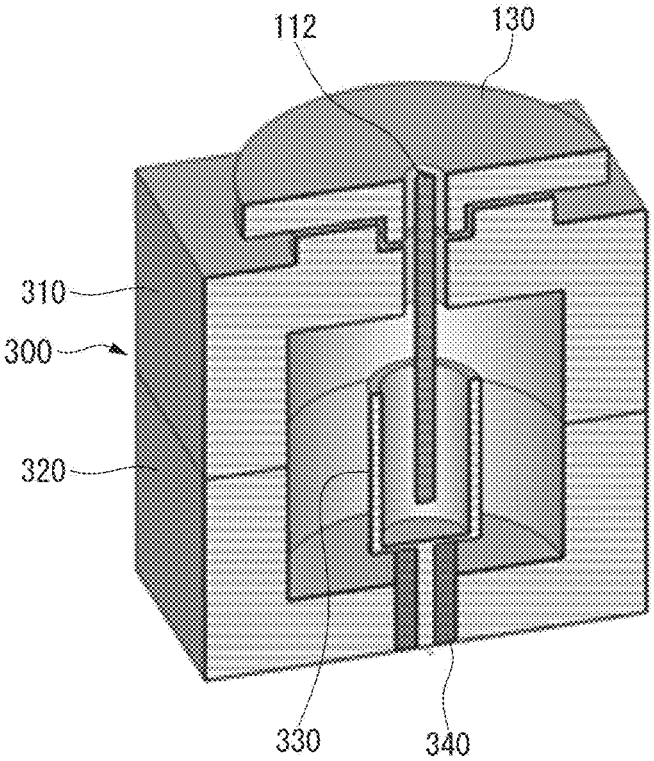
FIG. 9 is a longitudinal section view of a partial configuration of the radiating element of FIG. 8.
Figure 10:
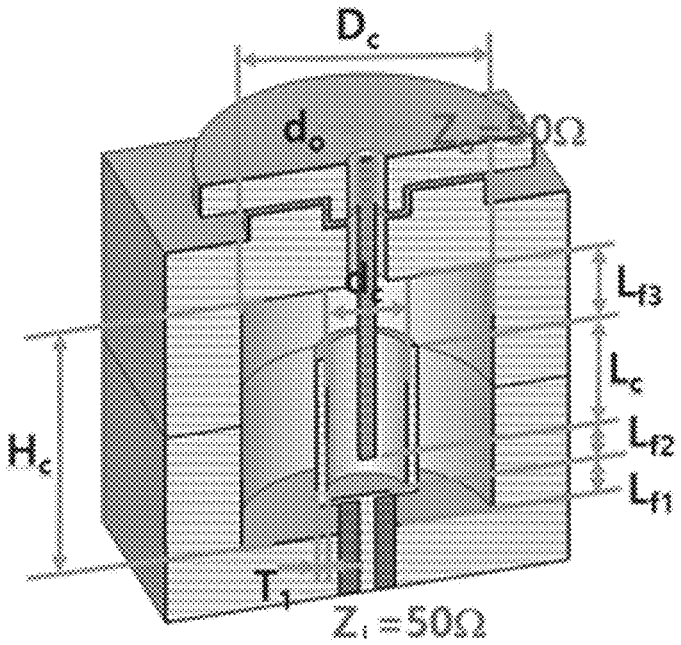
FIG. 10 is a longitudinal section view showing design variables of the partial configuration of the radiating element shown in FIG. 9.

FIG. 8 is a perspective view showing the bonding structure of the ground plate of the rotating radiating element and the spatial electromagnetic coupling structure in the radiating element of FIG. 2. FIG. 9 is a longitudinal section view of a partial configuration of the radiating element of FIG. 8. FIG. 10 is a longitudinal section view showing design variables of the partial configuration of the radiating element shown in FIG. 9.

Referring to FIGS. 8 and 9, the spatial electromagnetic coupling structure 300 of the rotating radiating element may have a shape which is axially symmetric with respect to a direction in which the feed pin 112 of the helix element 110 extends.

In other words, the rotating radiating element of this example embodiment includes the spatial electromagnetic coupling structure 300 which is axially symmetric. The spatial electromagnetic coupling structure 300 is a non-rotating body.

The upper structure 310 of the spatial electromagnetic coupling structure 300 is electrically opened from the ground plate 130 of the rotating body above the upper structure 310 or is not in contact with the ground plate 130. Meanwhile, the feed pin 112 of the helical radiating element performing a rotary motion is connected in a straight line to the upper structure 310. The lower structure 320 includes the feed supply 330 for coaxial feed and an external dielectric 340 at the dead center thereof and has a hollow structure for efficient capacitive electromagnetic coupling with the feed pin 112 of the helical radiating element.

The feed supply 330 and the external dielectric 340 are non-rotating structures, and the feed pin 112 and the feed supply 330 which is a cylindrical structure may have a capacitive electromagnetic coupling structure in which the feed pin 112 is a certain distance away from the feed supply 330.

The above-described feed pin 112 may be referred to as a "first feed pin" or an "upper feed pin," and the feed supply 330 may be referred to as a "second feed pin" or a "lower feed pin."

The hollow size of the spatial electromagnetic coupling structure 300, the coupling length between the upper and lower feed pins, the distance between the upper and lower feed pins, and the structural measurements of the hollow feed pin may be determined according to a design frequency required for optimal RF signal transmission between a non-rotating body and a rotating body.

Design variables of the spatial electromagnetic coupling structure 300 of the optimally designed rotating radiating element described above, that is, design variables of the rotary joint, are shown in FIG. 10, and optimal design values of the design variables under a specific condition are shown in Table 2 below.

TABLE 2

| Entry | | Design variable | Design value |
|---|---|---|---|
| Rotary joint | Hollow diameter | $D_c$ | 7.5 mm |
| | Hollow height | $H_c$ | 8.0 mm |
| | Coupling length between I/O feed pins | $L_c$ | 3.43 mm |
| | Internal diameter of input feed pin | $d_c$ | 2.4 mm |
| | Diameter of input feed pin | $d_o$ | 0.5 mm |
| | First input feed pin length | $L_{f1}$ | 1.0 mm |
| | Second input feed pin length | $L_{f2}$ | 1.17 mm |
| | External conductor thickness of input feed pin | T1 | 0.3 mm |
| | Output feed pin length | $L_{f3}$ | 2.25 mm |
| I/O coaxial impedance | Input | $Z_i$ | 50 Ω |
| | Output | $Z_o$ | 50 Ω |

As shown in Table 2, among the design variables of the spatial electromagnetic coupling structure 300, the hollow diameter $D_c$ of the rotary joint may be 7.5 mm, the hollow height $H_c$ may be 8.0 mm, the coupling length $L_c$ between the input and output feed pins may be 3.43 mm, the internal diameter $d_c$ of the input feed pin may be 2.4 mm, the diameter $d_o$ of the input feed pin may be 0.5 mm, the first length $L_{f1}$ of the input feed pin may be 1.0 mm, the second length $L_{f2}$ of the input feed pin may be 1.17 mm, the external conductor thickness $T_1$ of the input feed pin may be 0.3 mm, the length $L_o$ of the output feed pin may be 2.25 mm, and each of the input $Z_i$ and the output $Z_o$ of the input and output coaxial impedance may be 50Ω.

The rotating radiating element 100 and the driving unit 200 are coupled to the rotary joint, and then an optimization simulation is performed in the Ku band (11.75 GHz to 12.75 GHz) to verify a phase shift function and electrical performance in the RF band. The simulation results show that the rotary joint is useful as a part of an antenna element.

FIG. 11 is a set of diagrams showing phase shift states of the radiating element of FIG. 2. FIGS. 12A to 12D are graphs illustrating characteristics of a radiation pattern based on individual phase shifts of the radiating element of FIG. 2.

Figure 11A:
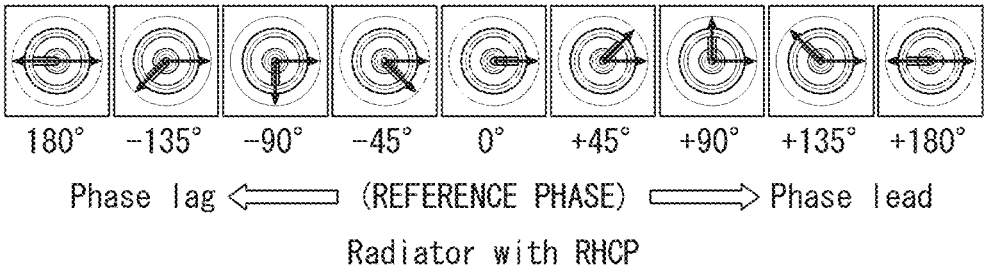
FIGS. 11A and 11B are sets of diagrams showing phase shift states of the radiating element of FIG. 2.
Figure 11B:
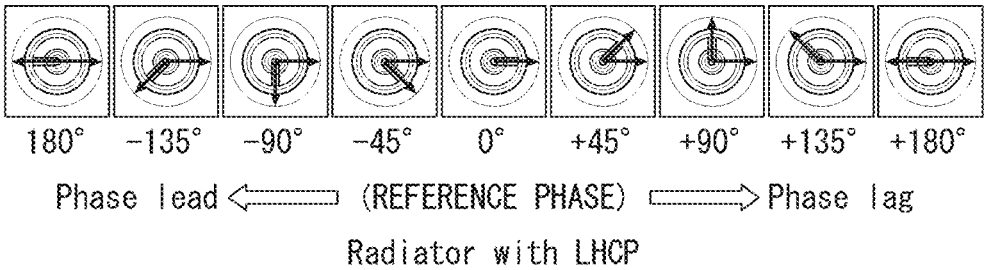
Figure 12A:
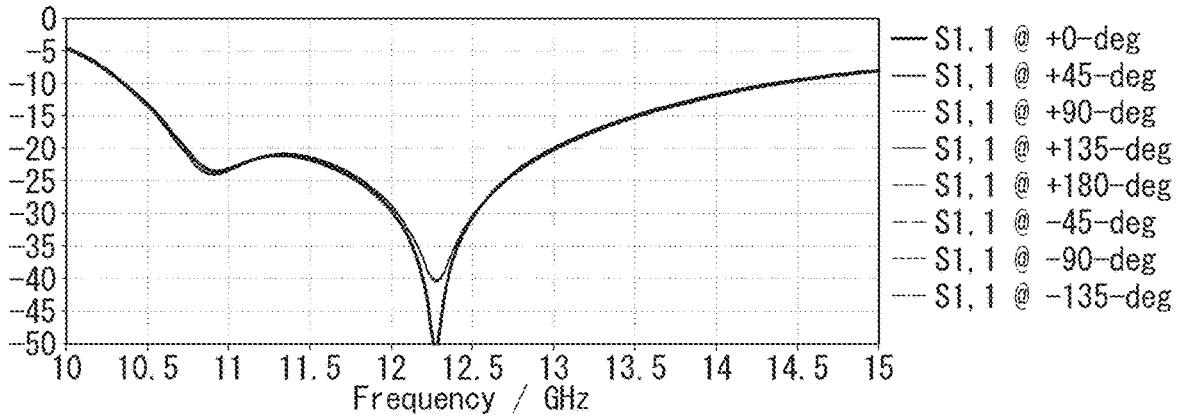
FIGS. 12A to 12D are graphs illustrating characteristics of a radiation pattern based on individual phase shifts of the radiating element of FIG. 2.
Figure 12B:
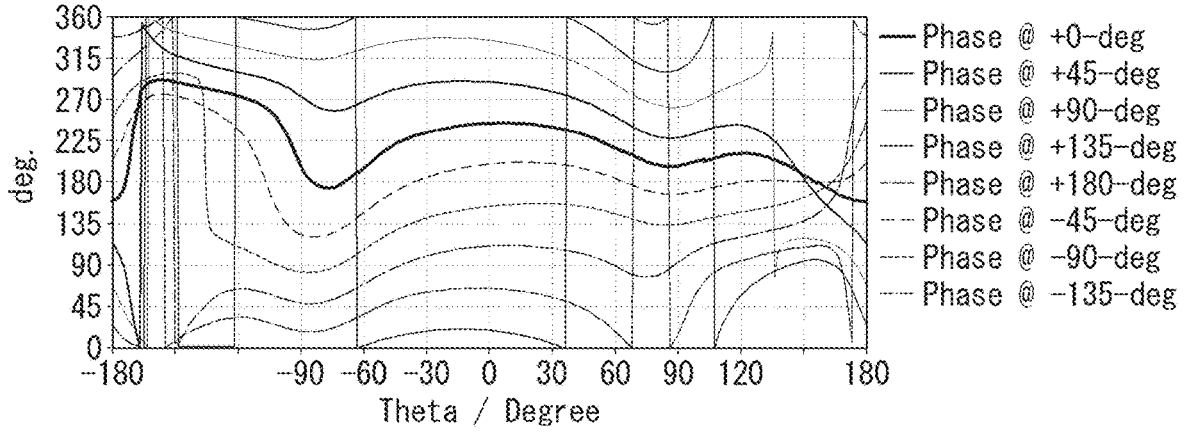
Figure 12C:
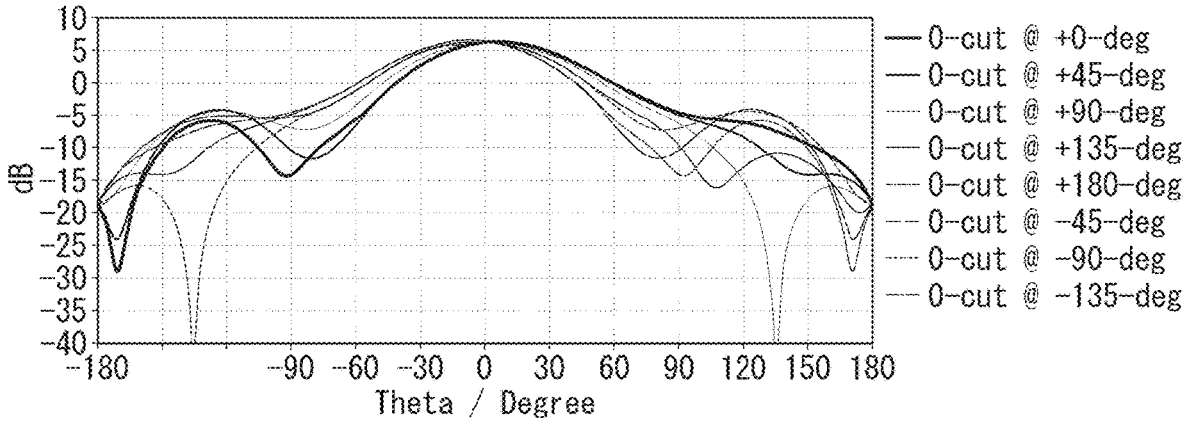
Figure 12D:
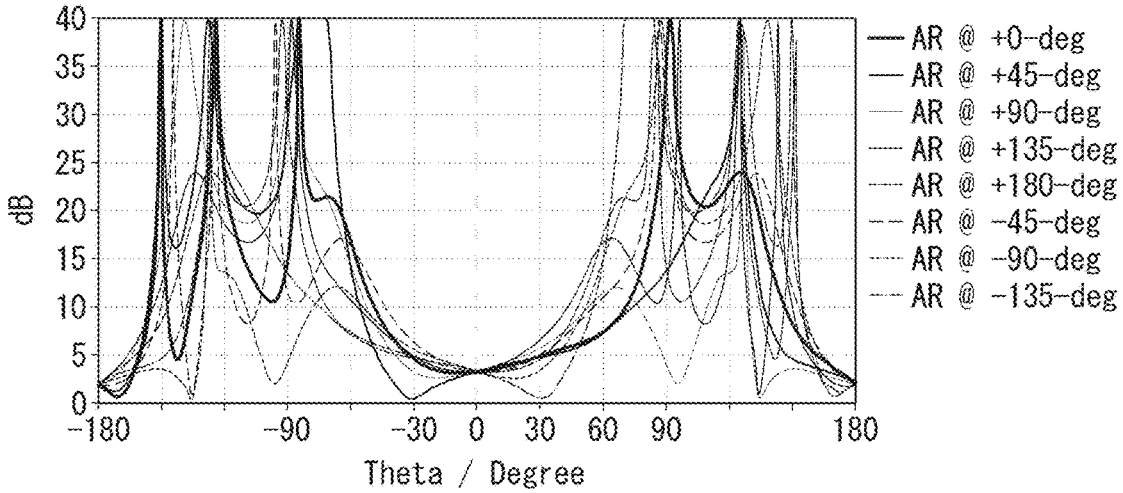

As shown in FIGS. 11A and 11B, phase shift states of a radiation pattern are displayed according to counterclockwise angular rotations of 45° based on an X axis of 0°. An angular rotation range is within left and right halfway turns, that is, ±180°.

As shown in FIG. 11A, assuming that a user observes while looking the antenna radiating element from the front, a radiating element having right-hand circular polarization (RHCP) shows a phase lead characteristic when moving counterclockwise or right and shows a phase lag characteristic when moving clockwise or left.

On the other hand, as shown in FIG. 11B, a radiating element having left-hand circular polarization (LHCP) shows a phase lag characteristic when moving counterclockwise or right and shows a phase lead characteristic when moving clockwise or left.

Results of simulating electrical characteristics of an antenna element in which a radiating element making angular rotation (see FIG. 2) is optimally designed in the Ku band (11.75 GHz to 12.75 GHz) are shown in FIGS. 12A to 12D.

As shown in FIGS. 12A to 12D, electrical characteristics according to angular rotation are very satisfactory, and in particular, the phase change characteristic of a 45° interval is excellent.

Table 1 and Table 2 may be referred to for optimal design variables of a helical radiating element and optimal design variables of a rotary joint in a radiating element, respectively.

According to the above-described example embodiment, it is possible to provide an inexpensive and lightweight passive phased array antenna element as an antenna element which causes an electrical phase lead or phase lag by rotating a resonant radiating element left or right. Also, an existing mechanical antenna which moves as a whole is large and heavy and thus cannot perform high-speed beamforming. Accordingly, the existing mechanical antenna performs only low-speed mechanical beamforming, and thus the performance of target tracking is not good enough. According to this example embodiment, however, an array antenna can be formed with individual radiating elements which are rotating bodies. Accordingly, it is possible to provide an array antenna which can form a high-speed antenna tracking beam compared to the existing mechanical antenna by rotating only lightweight radiating elements to rotate at a high speed for phase control.

Figure 13:
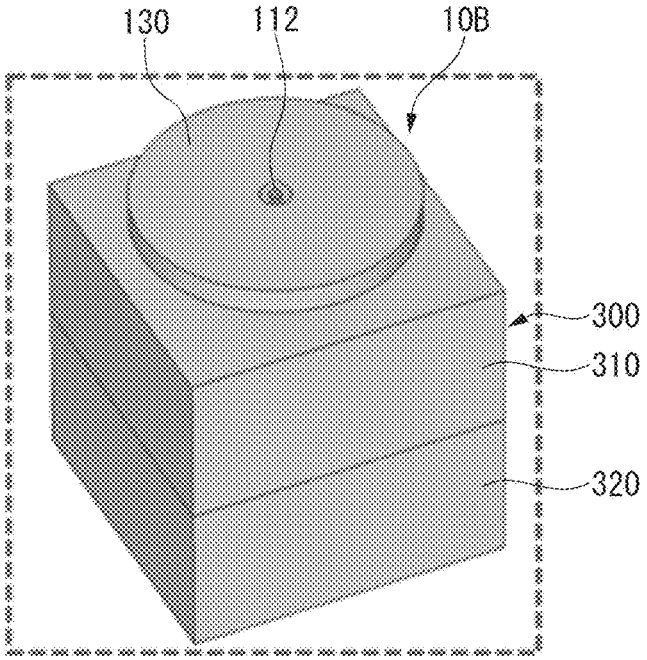
FIG. 13 is a perspective view of a partial configuration of a radiating element having an angular rotation function according to a second example embodiment of the present invention.
Figure 14:
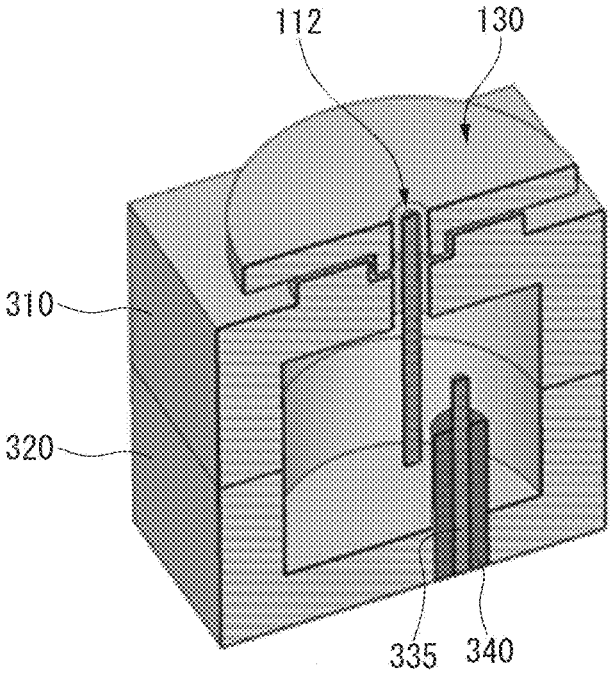
FIG. 14 is a longitudinal section view of the radiating element of FIG. 13.
Figure 15:
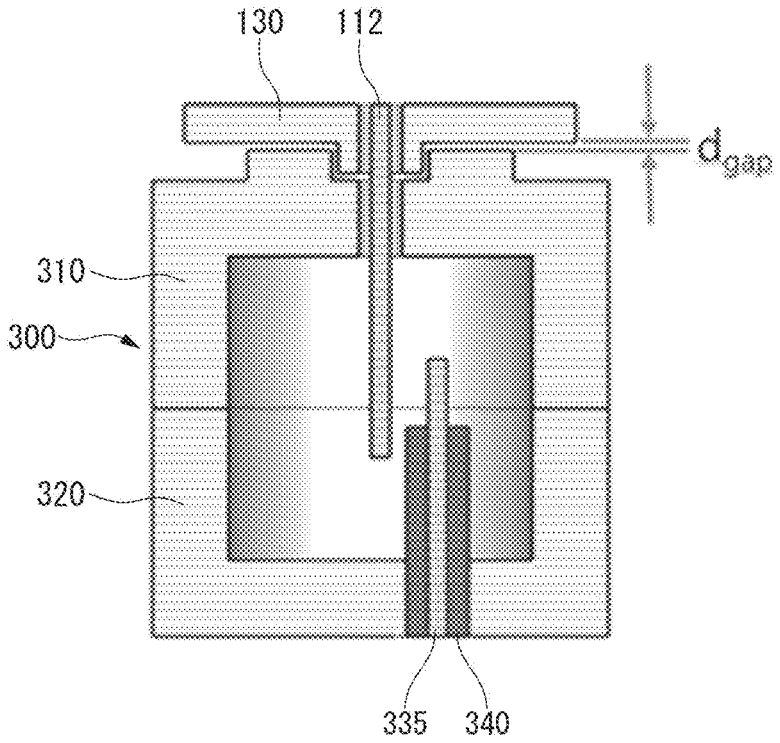
FIG. 15 is a front view of the single radiating element in FIG. 14.

FIG. 13 is a perspective view of a partial configuration of a radiating element having an angular rotation function according to a second example embodiment of the present invention. FIG. 14 is a longitudinal section view of the radiating element of FIG. 13. FIG. 15 is a front view of the radiating element of FIG. 14.

Referring to FIGS. 13 and 14, a partial configuration of a radiating element 10B of this embodiment includes a ground plate 130 and a spatial electromagnetic coupling structure 300. In other words, the radiating element 10B includes the spatial electromagnetic coupling structure 300 which is axially asymmetric. The spatial electromagnetic coupling structure 300 is a non-rotating body.

An upper structure 310 of the spatial electromagnetic coupling structure 300 is electrically opened from the ground plate 130 of a rotating body above the upper structure 310 or is not in contact with the ground plate 130. Meanwhile, a feed pin 112 which is an end portion of a helical radiating element performing a rotary motion is connected in a straight line to the upper structure 310. A feed supply 335, which is offset from the middle of the center portion of a lower structure 320 and coaxially fed, and an external dielectric 340 are non-rotating bodies, and an off-set distance is optimally determined for efficient capacitive electromagnetic coupling with the feed pin 112 of the helical radiating element performing a rotary motion.

According to a design frequency required for optimal RF signal transmission between a non-rotating body and a rotating body, the size of a hollow formed by the upper structure 310 and the lower structure 320 of the spatial electromagnetic coupling structure 300 and the coupling length and the off-set distance between upper and lower feed pins may be optimally determined.

FIG. 15 may be referred to for an RF connection configuration between a rotating body and a non-rotating body. As shown in FIG. 15, the one end of the helical radiating element 110 or the upper feed pin connected to the helical radiating element extends in a straight line from the center of the upper structure 310 and corresponds to an internal conductor of a coaxial feed line. Also, the ground plate 130 of the rotating body is separated from the upper structure 310 of the spatial electromagnetic coupling structure 300 by a certain distance $d_{gap}$ and thus corresponds to an external conductor which is not in contact with the coaxial feed line.

According to the above-described configuration, the certain distance and electrical contact area between the upper and lower ground surfaces are important design variables for low-loss RF signal transmission, that is, capacitive electromagnetic coupling. In this example embodiment, the certain distance between the ground surfaces is maintained by the driving unit (see 200 in FIG. 2).

Figure 16:
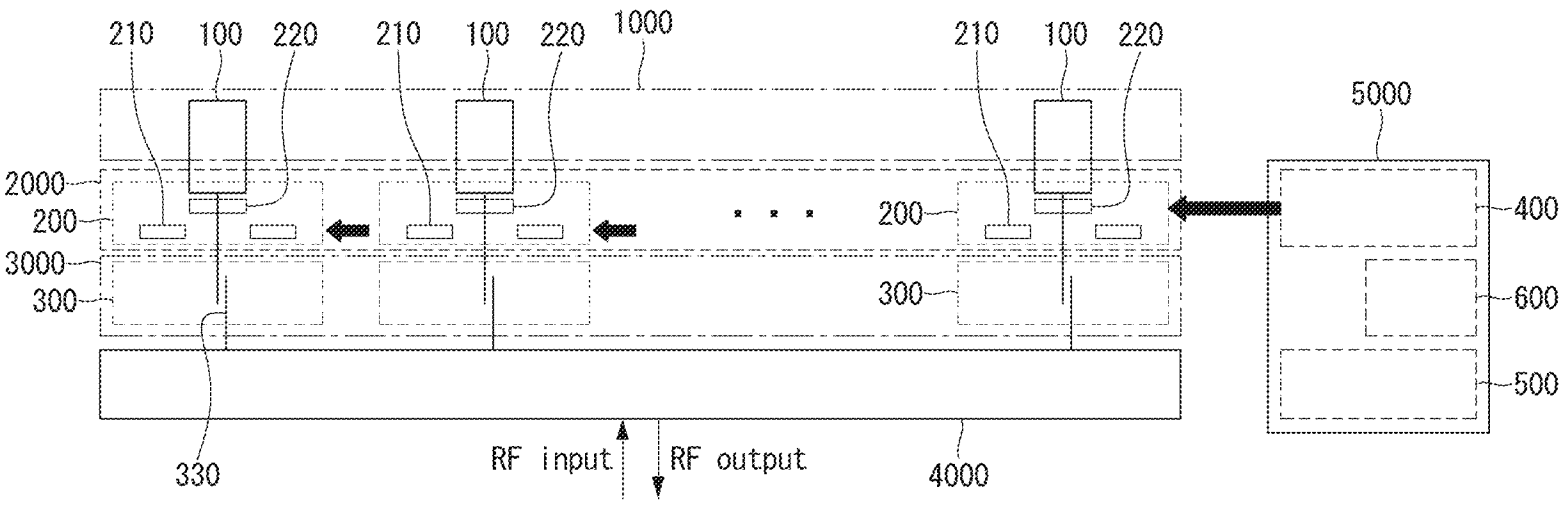
FIG. 16 is a schematic block diagram of a configuration of an array antenna including a feed circuit network which may control the angular phases of antenna array elements according to a third example embodiment of the present invention.

FIG. 16 is a schematic block diagram of a configuration of an array antenna including a feed circuit network which may control the angular phases of antenna array elements according to a third example embodiment of the present invention.

Referring to FIG. 16, the phased array antenna is a passive array antenna. The phased array antenna may operate separately as a transmitting array antenna and a receiving array antenna and may operate as an array antenna for both transmitting and receiving. When the phased array antenna operates as the array antenna for both transmitting and receiving, a transmitting and receiving separation device, for example, a circulator or an orthogonal mode transducer, may be used at the input end or output end.

The phased array antenna includes a radiation array 1000 in which a plurality of radiating elements 100 having individual rotary motions are arranged in one dimension or two dimensions, a driving unit arrangement 2000 in which driving units 200 for separately causing the radiating elements 100 to mechanically perform a left-hand or right-hand rotary motion according to external control are arranged in one dimension or two dimensions, and a spatial feed network 3000 in which unit feed structures having spatial electromagnetic coupling under the driving units 200, that is, spatial electromagnetic coupling structures 300, are arranged in one dimension or two dimensions.

Input or output ports of the phased array antenna are connected to an output or input port of a feed circuit network 4000 coupled to the spatial electromagnetic coupling structure such that power is combined or power is distributed between the phased array antenna and the feed circuit network 4000. The simple low-loss feed network 4000 may provide a function for amplitude control of array antenna apertures, for example aperture tapering, to shape the radiation pattern of the array antenna through, for example, sidelobe level control.

Peripherals 5000 for the array antenna may include an antenna control unit 400, a power supply unit 500 for supplying power to an active device and a processor, and a sensor unit 600 for controlling various open loops.

The antenna control unit 400 supplies mechanical phase control data, power, etc. calculated on the basis of information acquired through a target tracking algorithm for open-loop and closed-loop tracking and the like to each of the driving units 200 in the driving unit arrangement 2000.

At least a part of the above-described peripherals 5000 may be implemented as a hardware component, a software component, and/or a combination of a hardware component and a software component. For example, at least a part of the peripherals 5000 may be implemented with one or more general-use computers or special-purpose computers such as a processor, a controller, an arithmetic logic unit (ALU), a digital signal processor, a microcomputer, a field programmable array (FPA), a programmable logic unit (PLU), a microprocessor, or any other device for executing and responding to an instruction.

In particular, an operating system (OS) and one or more software applications executed on the OS may be installed on the antenna control unit 400. In response to execution of software, the antenna control unit 400 may access, store, manipulate, process, and generate data. The antenna control unit 400 may include a plurality of processing elements and/or a plurality of types of processing elements. For example, the antenna control unit 400 may include a plurality of processors or one processor and one controller and may also include another processing configuration such as a parallel processor.

The mechanical passive phased array antenna of this example embodiment may be run on the basis of relatively high-speed rotary motions because radiating elements are lightweight. Accordingly, it is possible to effectively implement a passive phased array antenna system which consumes little power, has a low external height, weighs little, and is inexpensive (see the shape and beam scanning of a two-dimensional passive phased array antenna employing individual rotating radiating elements in FIGS. 25 and 30).

Figure 17:
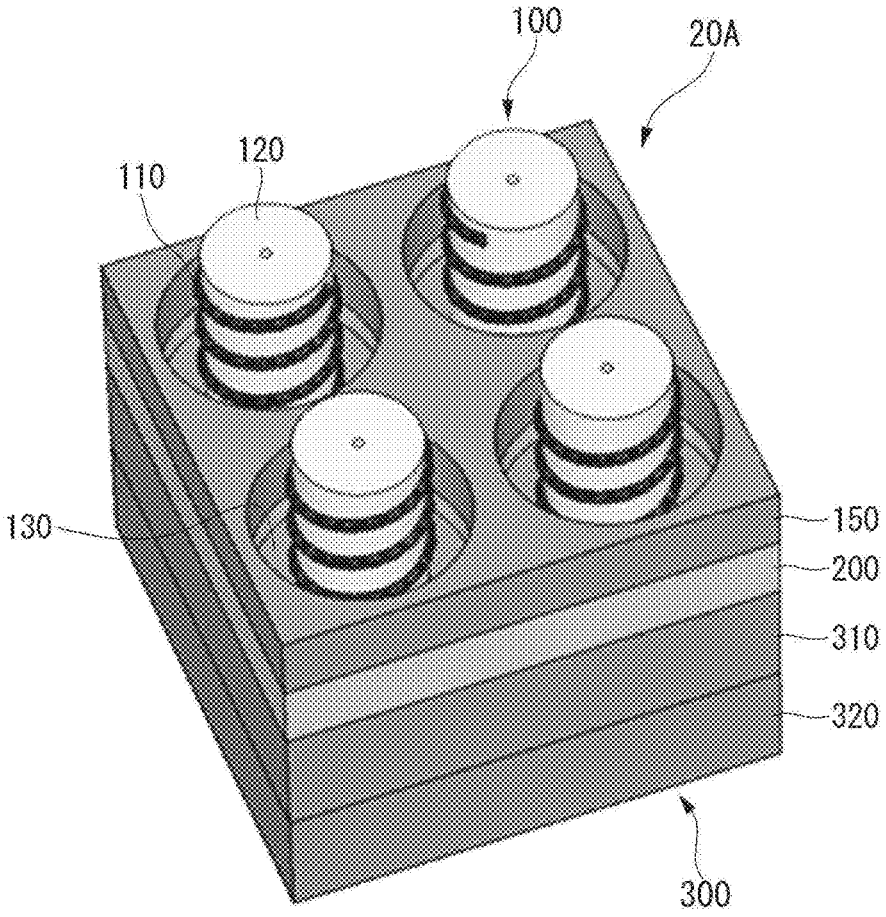
FIG. 17 is a perspective view of an array antenna according to a fourth example embodiment of the present invention.
Figure 18:
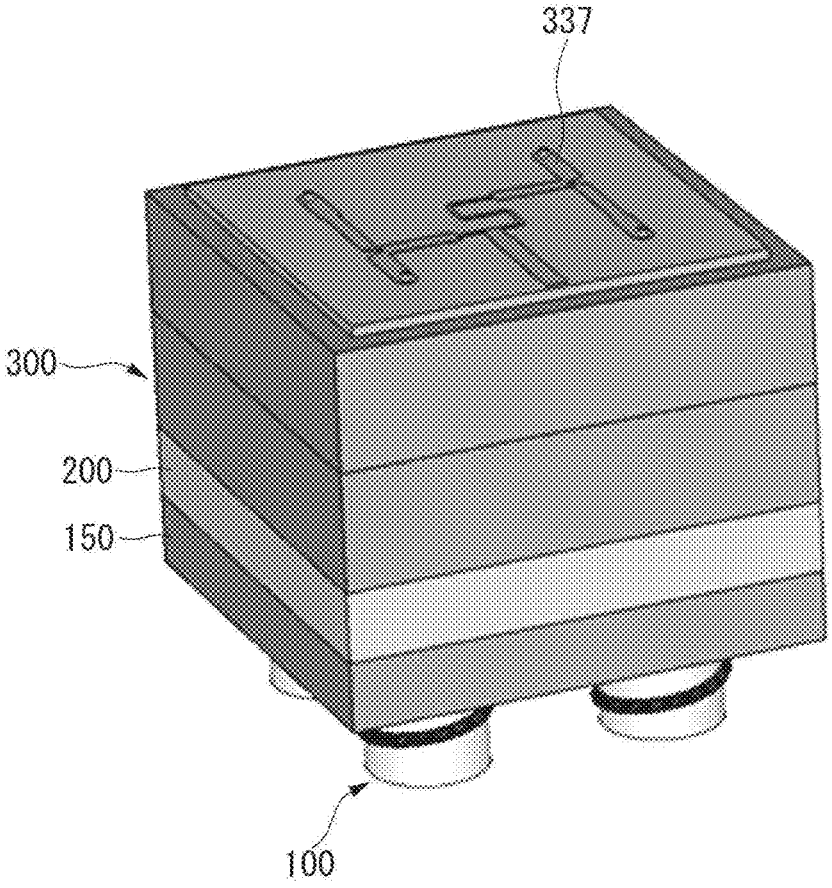
FIG. 18 is a perspective bottom view of the array antenna of FIG. 17.
Figure 19:
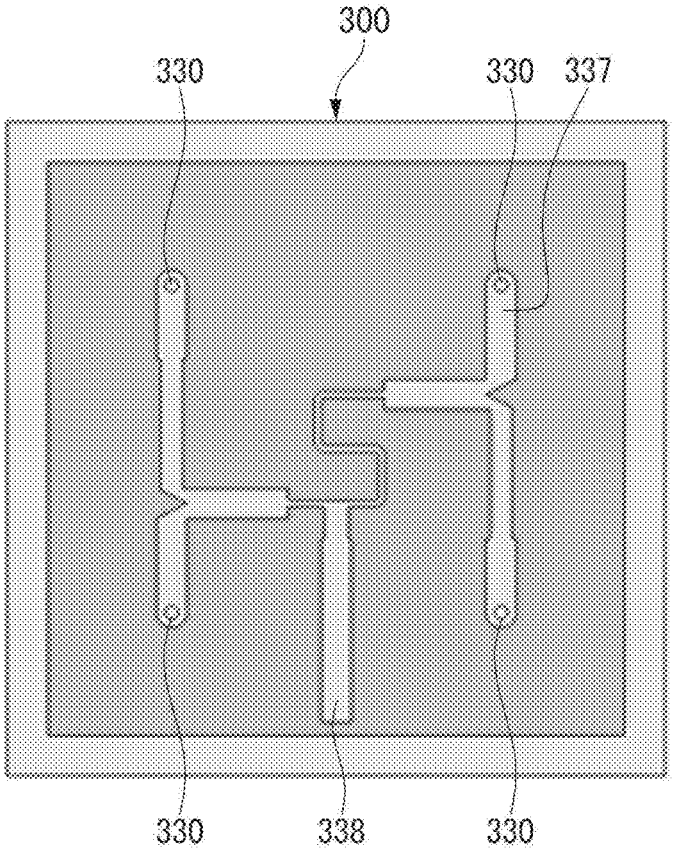
FIG. 19 is a bottom view of the array antenna of FIG. 17.

FIG. 17 is a perspective view of an array antenna according to a fourth example embodiment of the present invention. FIG. 18 is a perspective bottom view of the array antenna of FIG. 17. FIG. 19 is a bottom view of the array antenna of FIG. 17.

Referring to FIGS. 17 to 19, a group radiating element 20A according to this example embodiment includes four rotating radiating elements 100, a driving unit 200 for actuating the four rotating radiating elements 100 individually or as at least one group, and a spatial electromagnetic coupling structure 300 for transmitting an RF signal to each of the rotating radiating elements 100.

Each of the rotating radiating elements 100 includes a helix element 110, an auxiliary structure 120, and a ground plate 130, and the spatial electromagnetic coupling structure 300 includes an upper structure 310 and a lower structure 320.

The radiating element 20A may further include an upper support frame 150 for confining each of the rotating radiating elements 100 in a cylindrical sidewall having a certain height and maintaining the separation distance between the rotating radiating elements 100.

Also, the radiating element 20A may include a microstrip line 337 for feeding in the external bottom surface of the spatial electromagnetic coupling structure 300 or the lower structure 320.

As shown in FIG. 19, the microstrip line 337 may include one end 338 connected to a power supply side and four other ends connected to a feed supply 330. The other ends of the microstrip line 337 may be separately connected to ends of the feed supply 330 by spot welding or the like.

Figure 20:
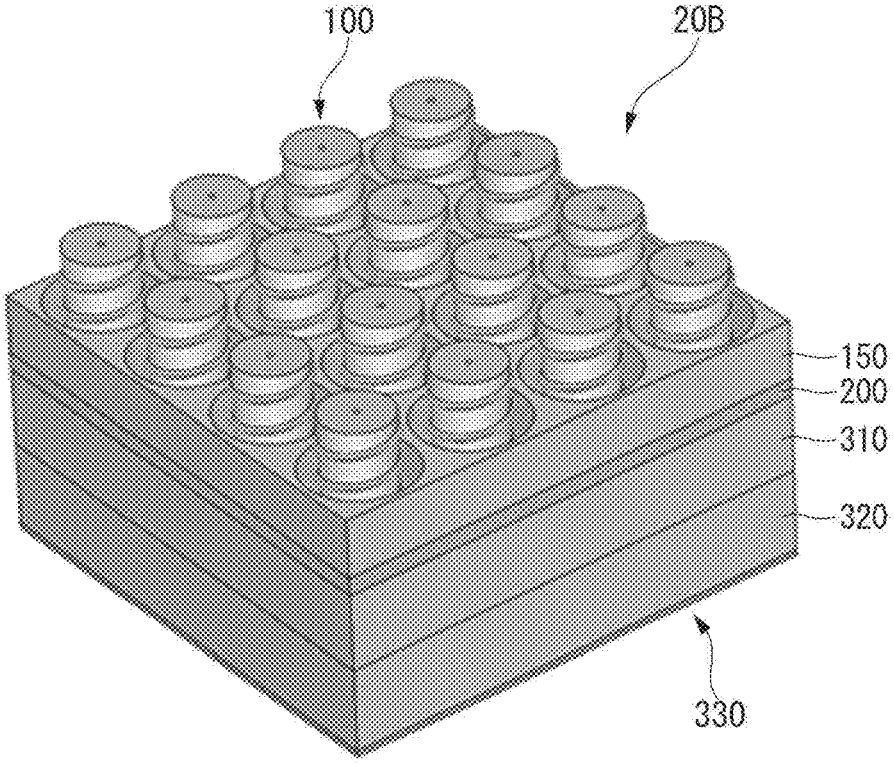
FIG. 20 is a perspective view of an array antenna according to a fifth example embodiment of the present invention.
Figure 21:
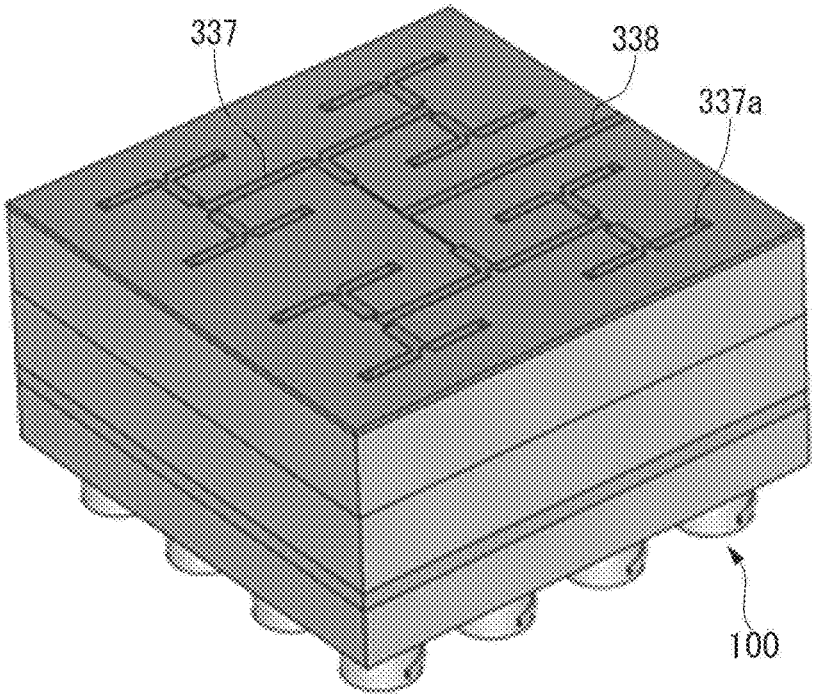
FIG. 21 is a perspective bottom view of the array antenna of FIG. 20.
Figure 22:
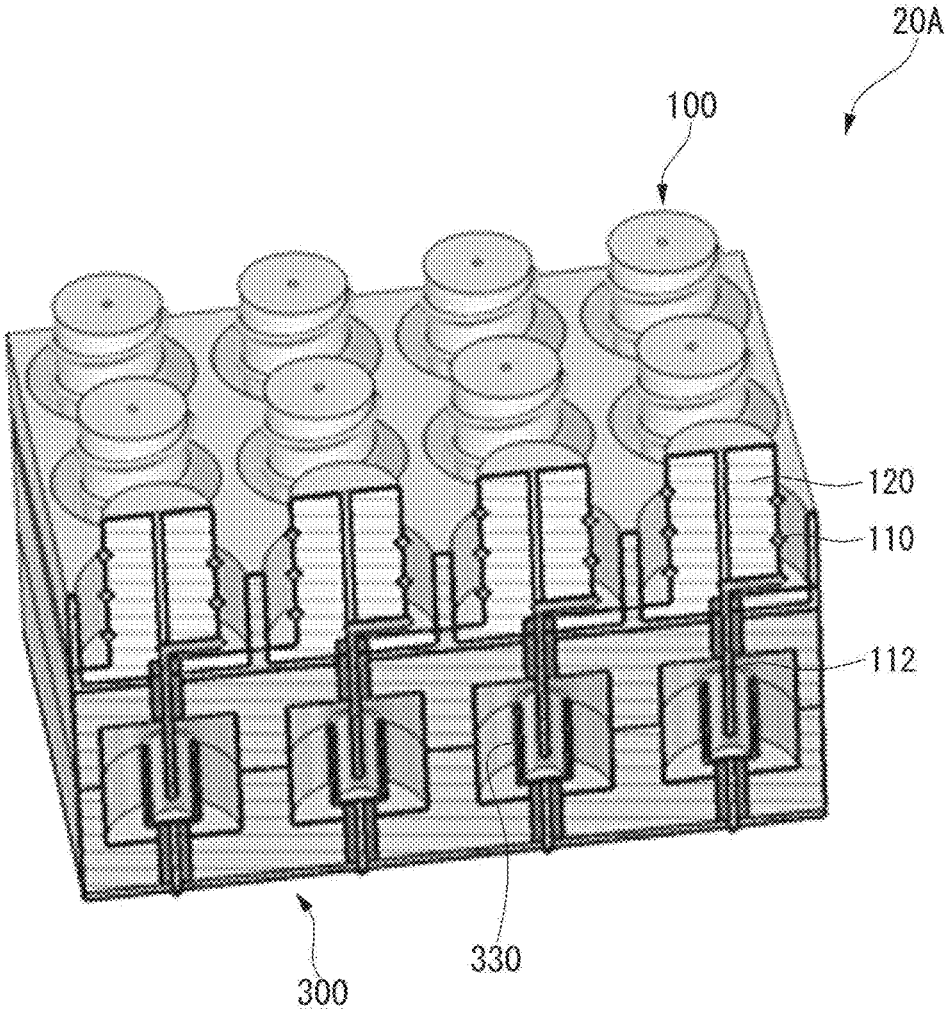
FIG. 22 is a longitudinal section view of the array antenna of FIG. 20.
Figure 23:
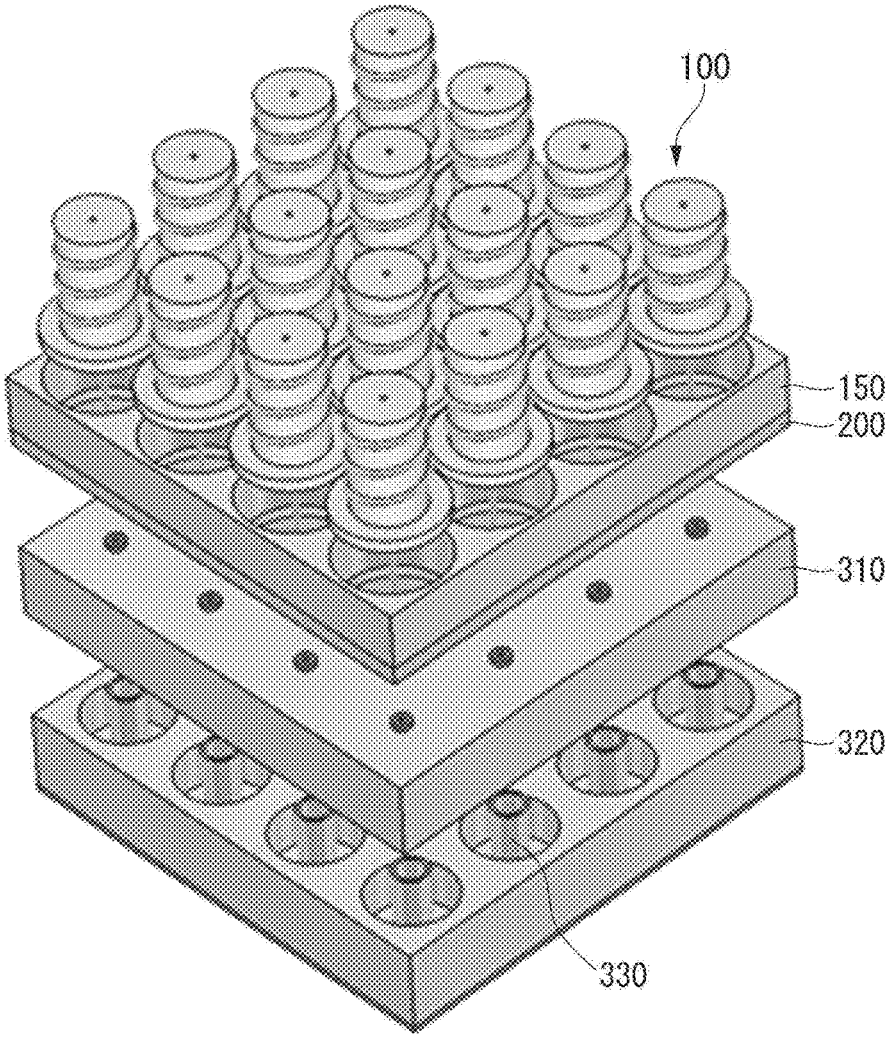
FIG. 23 is an exploded perspective view of the array antenna of FIG. 20.
Figure 24:
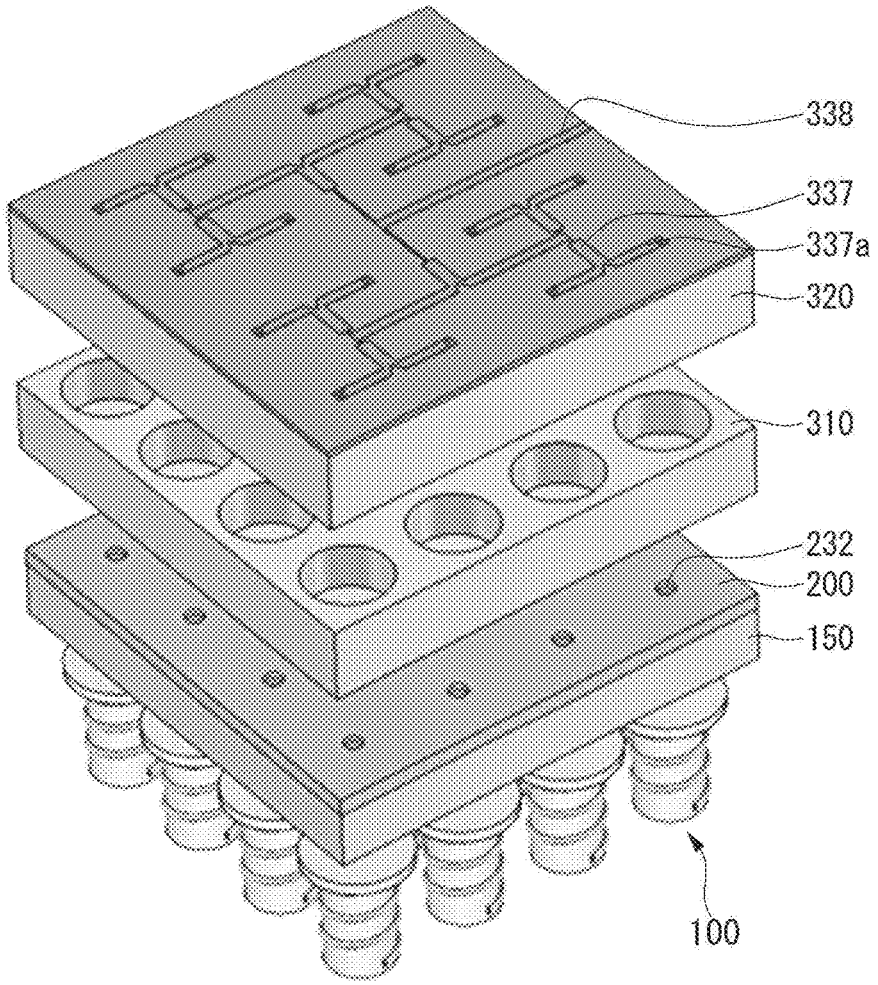
FIG. 24 is an exploded perspective bottom view of the array antenna of FIG. 20.
Figure 25:
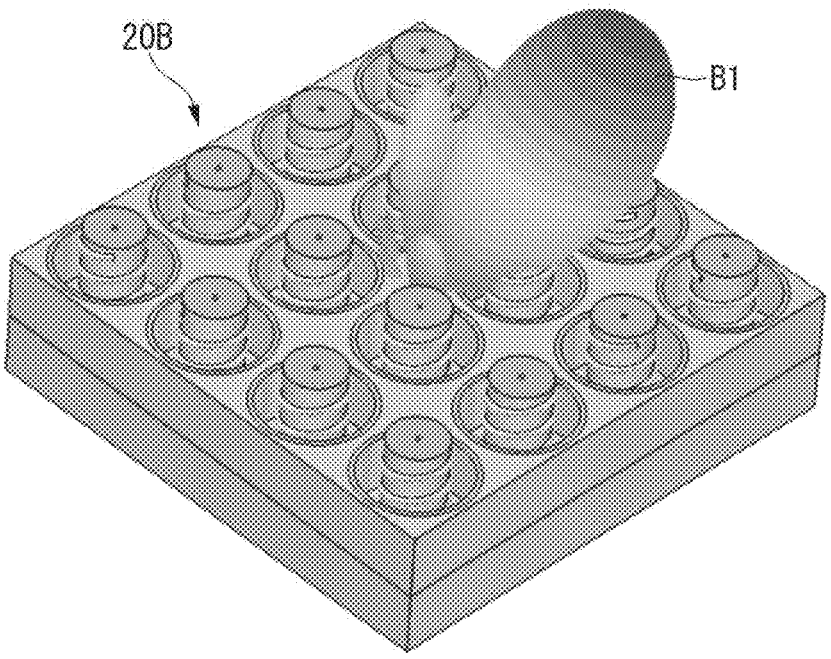
FIG. 25 is an example view showing an operating state of the array antenna of FIG. 20.

FIG. 20 is a perspective view of an array antenna according to a fifth example embodiment of the present invention. FIG. 21 is a perspective bottom view of the array antenna of FIG. 20. FIG. 22 is a longitudinal section view of the array antenna of FIG. 20. FIG. 23 is an exploded perspective view of the array antenna of FIG. 20. FIG. 24 is an exploded perspective bottom view of the array antenna of FIG. 20. FIG. 25 is an example view showing an operating state of the array antenna of FIG. 20.

Referring to FIGS. 20 to 24, an array antenna 20B according to this example embodiment includes 16 rotating radiating elements 100 or four group radiating elements 100 and also includes a driving unit arrangement 2000 (see FIG. 16) for actuating the 16 rotating radiating elements 100 individually or as at least one group and a spatial feed network 3000 (see FIG. 16) for transmitting an RF signal to each of the rotating radiating elements 100. The driving unit arrangement 2000 may include 16 driving units, and the spatial feed network 3000 may include 16 spatial electromagnetic coupling structures.

Each of the rotating radiating elements 100 includes a helix element 110, an auxiliary structure 120, and a ground plate 130, and each of the spatial electromagnetic coupling structures 300 includes an upper structure 310 and a lower structure 320.

The array antenna 20B may further include an upper support frame 150 for confining each of the rotating radiating elements 100 in a cylindrical sidewall having a certain height and maintaining the separation distance between the rotating radiating elements 100.

Also, the array antenna 20B may include a microstrip line 337 for feeding in the external bottom surface of the spatial feed network 3000 as shown in FIG. 21. The microstrip line 337 may include one end 338 connected to a power supply side and 16 other ends 337*a* connected to a feed supply 330. The other ends 337*a* may be separately connected to ends of the feed supply 330 by spot welding or the like.

In the driving unit arrangement 2000, 16 through holes that feed pins 112 of the 16 helix elements 110 pass through separately may be arranged. The driving unit arrangement 2000 may include therein a rotor disposed around each of the through holes and a stator disposed around the rotor for electromagnetic coupling.

The spatial feed network 3000 may include an upper feed network and a lower feed network for the 16 spatial electromagnetic coupling structures. In the upper feed network, 16 through holes that the feed pins 112 of the 16 helix elements 110 pass through separately may be arranged.

Between the upper feed network and the lower feed network, 16 unit feed spaces may be separately arranged with the 16 rotating radiating elements 100 for spatial electromagnetic coupling. In each of the unit feed spaces, a feed supply 330 corresponding to a lower feed pin is disposed to be electromagnetically coupled with the feed pin 112 of the helix element 110 corresponding to an upper feed pin in the air under a feed condition.

According to this example embodiment, as shown in FIG. 25, the two-dimensional passive phased array antenna 20B employing the 16 individual rotating radiating elements can perform beam scanning while forming a radiation pattern B1 in any direction.

Figure 26:
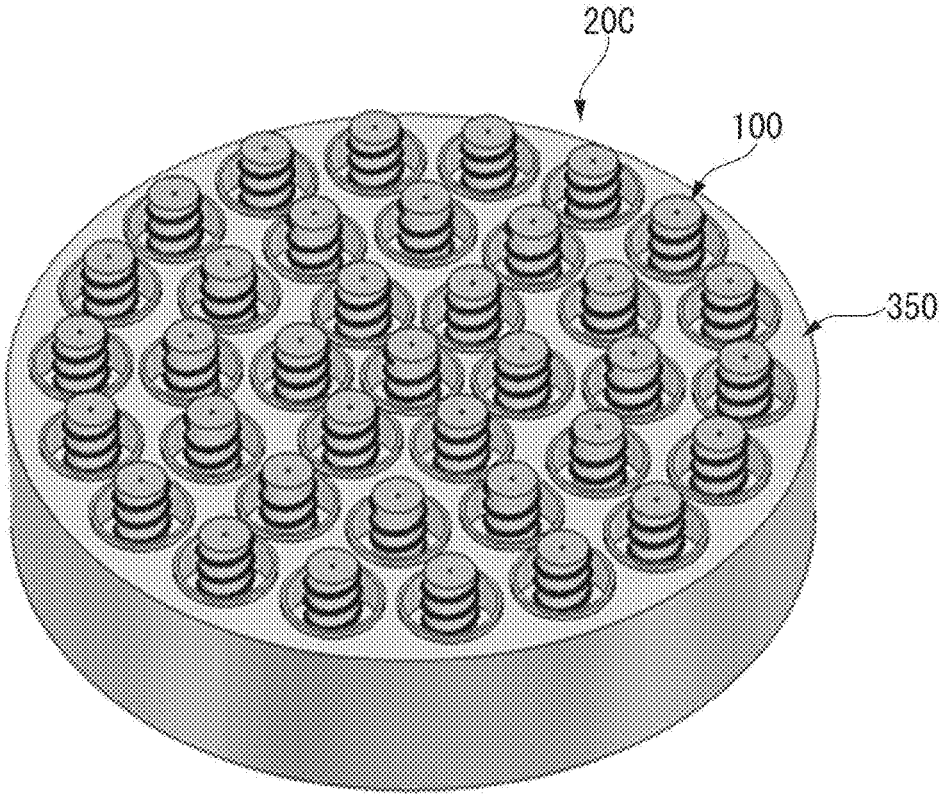
FIG. 26 is a perspective view of an array antenna according to a sixth example embodiment of the present invention.
Figure 27:
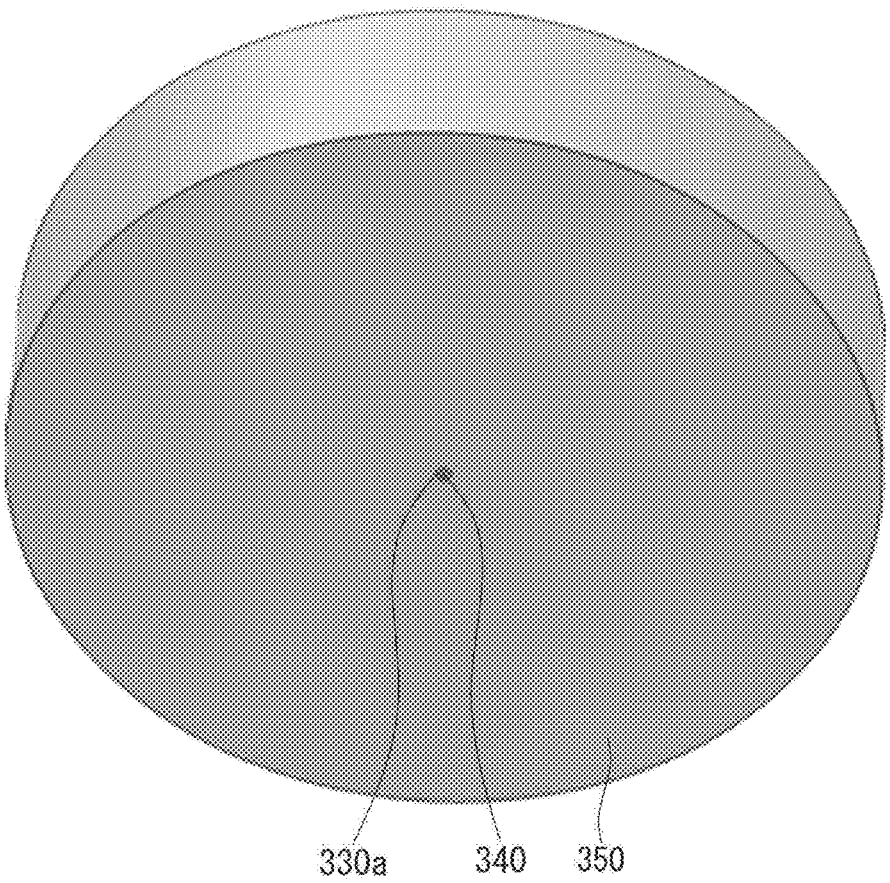
FIG. 27 is a perspective bottom view of the array antenna of FIG. 26.
Figure 28:
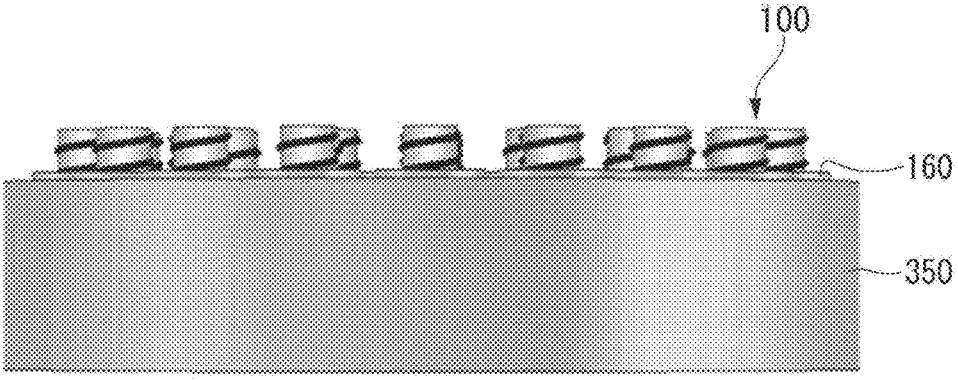
FIG. 28 is a front view of the array antenna of FIG. 26.
Figure 29:
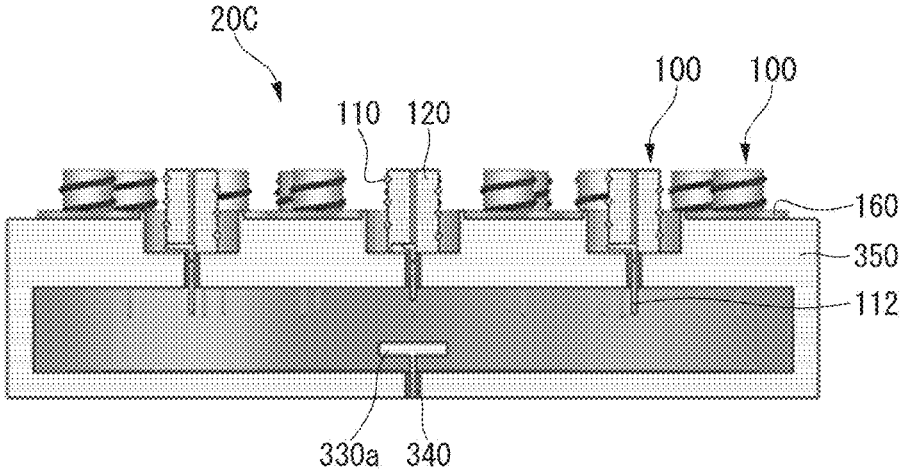
FIG. 29 is a longitudinal section view of the array antenna of FIG. 28.
Figure 30:
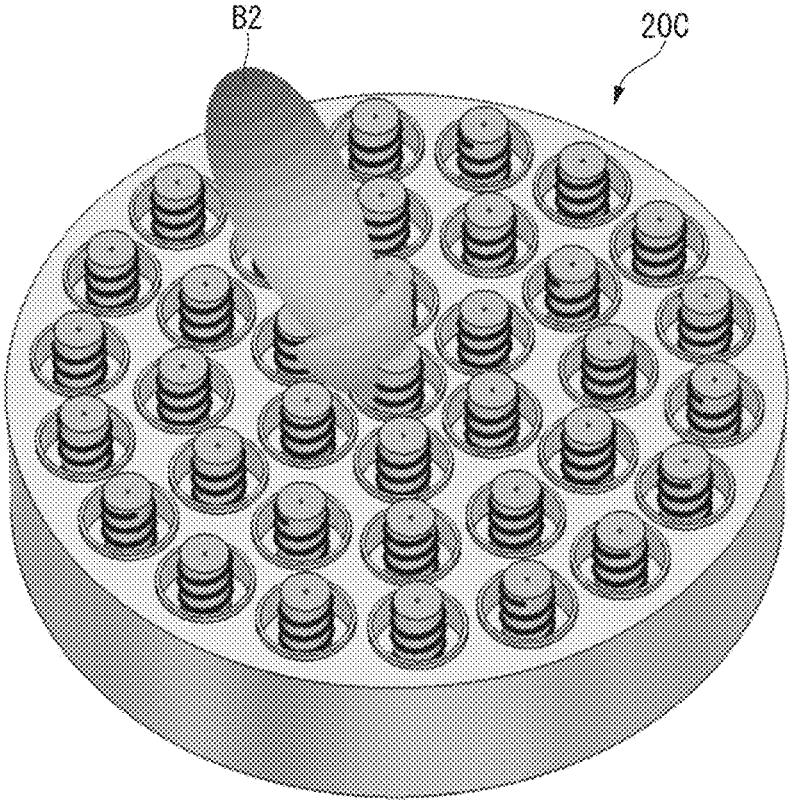
FIG. 30 is an example view showing a beam scanning operation state of the array antenna of FIG. 26.

FIG. 26 is a perspective view of an array antenna according to a sixth example embodiment of the present invention. FIG. 27 is a perspective bottom view of the array antenna of FIG. 26. FIG. 28 is a front view of the array antenna of FIG. 26. FIG. 29 is a longitudinal section view of the array antenna of FIG. 28. FIG. 30 is an example view showing a beam scanning operation state of the array antenna of FIG. 26.

Referring to FIG. 26, an array antenna 20C according to this example embodiment includes 37 rotating radiating elements 100, a driving unit arrangement for actuating the 37 rotating radiating elements 100 individually or as at least one group, and a spatial feed network for transmitting an RF signal to each of the rotating radiating elements 100. The driving unit arrangement may include 37 driving units, and the spatial feed network may include 37 spatial electromagnetic coupling structures or inner spaces for electromagnetic coupling.

The array antenna 20C may further include a support frame 350 for confining each of the rotating radiating elements 100 in a cylindrical sidewall having a certain height and maintaining the separation distance between adjacent two of 37 rotating radiating elements 100.

The support frame 350 may be integrally formed with the driving unit arrangement and the spatial electromagnetic coupling structure and may additionally include a microstrip line for feeding therein. However, the support frame 350 is not limited thereto and may be configured to feed the single rotating radiating elements 100 through a single feed supply.

As shown in FIGS. 27 to 29, one end of a feed supply 330*a* may be exposed in the bottom surface of the support frame 350, and an external dielectric 340 may be disposed between the support frame 350 and the feed supply 330*a* at the bottom of the support frame 350. The feed support 330*a* may be exposed together with feed pins 112 of the rotating radiating elements 100 in an electromagnetic coupling space inside the support frame 350 and electromagnetically coupled when power is supplied.

Also, the support frame 350 has an actuator arrangement function and may include 37 through holes that the feed pins 112 of the 37 helix elements 110 separately pass through. The support frame 350 may include therein a rotor disposed around each of the through holes and a stator disposed around the rotor for electromagnetic coupling.

In the array antenna 20C, separation frames 160 may be inserted between the rotating body and the non-rotating body for spacing or electrical separation therebetween. The separation frames 160 may be separately installed to surround each of the side surfaces of the rotating radiating elements 100 or connected to each other in the form of a net or network.

According to this example embodiment, as shown in FIG. 30, the two-dimensional passive phased array antenna 20C employing 37 individual rotating radiating elements can perform beam scanning while forming a radiation pattern B2 in any direction.

According to the present invention, it is possible to provide a passive phased array antenna element which employs circularly polarized radiating elements making angular rotation through an external control circuit, performs phase control by separately controlling the circularly polarized radiating elements arranged in a linear or planar array as array elements, and controls an antenna radiation beam through uniform or non-uniform amplitude distribution or coupling in a simple low-loss feed circuit network.

Also, according to the present invention, an electronic beamforming function of an array antenna can be implemented without using additional phase shifter devices required for the existing phased array antenna, and thus it is possible to remarkably reduce the volume, the weight, the power consumption, and the manufacturing cost of an array antenna compared to an existing transmitting or receiving phased array antenna.

Further, according to the present invention, it is possible to effectively develop a small or portable phased array antenna element which is inexpensive, consumes little power, and can perform electron beam scanning. Accordingly, the phased array antenna element can replace expensive active phased array antennas in applications in the field of wireless communication such as satellite communication and mobile communication, and a strong economic effect is expected in the array antenna market accordingly.

What is claimed is:

1. An individual rotating radiating element comprising:

an auxiliary structure formed of a dielectric;

a helix element inserted into a spiral groove on a side surface of the auxiliary structure;

a ground plate coupled to a lower surface of the auxiliary structure;

a driving unit including an opening in which the ground plate is placed and rotating the auxiliary structure in which the helix element is inserted together with the ground plate; and a spatial electromagnetic coupling structure in which a first feed pin coupled to a low portion of the driving unit and connected to one end of the helix element penetrates a center of the ground plate and is inserted from an upper surface of the spatial electromagnetic coupling structure and in which a second feed pin electromagnetically coupled with the first feed pin during power feeding is inserted through a lower surface spaced apart from the upper surface with an inner space therebetween, wherein the second feed pin is disposed on one side apart from an end portion of the first feed pin to be electromagnetically coupled with the end portion of the first feed pin when the power is fed.

2. The individual rotating radiating element of claim 1, wherein the spatial electromagnetic coupling structure includes an upper concave and convex portion installed on the upper surface thereof, and the upper concave and convex portion is spaced apart from a lower concave and convex portion of a lower portion of the ground plate to fit or to be insertion-coupled.

3. The individual rotating radiating element of claim 2, wherein a distance between the upper concave and convex portion and the lower concave and convex portion is determined based on a design frequency band, as a design variable of capacitive electromagnetic coupling for low-loss radio frequency (RF) signal transmission.

4. The individual rotating radiating element of claim 1, wherein a diameter of the helix element is equal to a diameter of the auxiliary structure or smaller than a diameter of the ground plate.

5. The individual rotating radiating element of claim 4, wherein a height of the helix element is larger than the diameter of the helix element.

6. The individual rotating radiating element of claim 1, wherein a size of the inner space of the spatial electromagnetic coupling structure and a coupling length and a distance between the first feed pin and the second feed pin are determined based on a design frequency band.

7. An array antenna comprising:

a plurality of radiating elements arranged apart from each other with an array;

a driving units arrangement configured to support each of the plurality of radiating elements; and a spatial feed network configured to be spatially and electromagnetically coupled with the plurality of radiating elements, wherein each of the plurality of radiating elements comprises:

an auxiliary structure formed of a dielectric;

a helix element inserted into a spiral groove on a side surface of the auxiliary structure; and a ground plate coupled to a lower surface of the auxiliary structure, wherein the driving units arrangement comprises a plurality of driving units having an opening in which the ground plate is placed and rotating the auxiliary structure in which the helix element is inserted together with the ground plate, and wherein the spatial feed network comprises at least one spatial electromagnetic coupling structure in which a first feed pin coupled to a low portion of the driving units arrangement and connected to one end of the helix element penetrates a center of the ground plate and is inserted from an upper surface of the at least one spatial electromagnetic coupling structure and in which a second feed pin electromagnetically coupled with the first feed pin during power feeding is inserted through a lower surface spaced apart from the upper surface with an inner space therebetween, wherein the second feed pin is disposed on one side apart from an end portion of the first feed pin to be electromagnetically coupled with the end portion of the first feed pin when the power is fed.

8. The array antenna of claim 7, wherein the at least one spatial electromagnetic coupling structure includes an upper concave and convex portion installed on the upper surface thereof, and the upper concave and convex portion is spaced apart from a lower concave and convex portion of a lower portion of the ground plate to fit or to be insertion-coupled.

9. The array antenna of claim 8, wherein a distance between the upper concave and convex portion and the lower concave and convex portion is determined based on a design frequency band, as a design variable of capacitive electromagnetic coupling for low-loss radio frequency (RF) signal transmission.

10. The array antenna of claim 7, wherein a diameter of the helix element is equal to a diameter of the auxiliary structure or smaller than a diameter of the ground plate.

11. The array antenna of claim 10, wherein a height of the helix element is larger than the diameter of the helix element.

12. The array antenna of claim 7, wherein a size of the inner space of the spatial electromagnetic coupling structure and a coupling length and a distance between the first feed pin and the second feed pin are determined based on a design frequency band.

13. The array antenna of claim 7, wherein the spatial feed network includes a plurality of spatial feed electromagnetic coupling structures, wherein spatial feed network provides a function for amplitude control of an array antenna aperture to shape a radiation pattern of the array antenna through sidelobe level control.

14. The array antenna of claim 7, further comprising peripherals for the array antenna connected to the driving units arrangement and the spatial feed network, wherein the peripherals comprises an antenna control unit configured to individually control operations of the plurality of driving units in the driving units arrangement on the basis of mechanical phase control data which is calculated in advance.

15. The array antenna of claim 14, wherein the peripherals further comprises a sensor unit for open loop control, and a signal detected by the sensor unit is transmitted to the antenna control unit.

16. The array antenna of claim 7, wherein the spatial feed network includes the inner space in which a plurality of first feed pins are electromagnetically coupled with a single second feed pin.

* * * * *